US010621818B2

(12) United States Patent
Cerro et al.

(10) Patent No.: US 10,621,818 B2
(45) Date of Patent: Apr. 14, 2020

(54) SOCIAL NETWORK WAGERING SYSTEM

(71) Applicant: Gamblit Gaming, LLC, Glendale, CA (US)

(72) Inventors: Melissa Cerro, Agoura, CA (US); Bryce Cire, Los Angeles, CA (US); Frank Cire, Pasadena, CA (US); Taylor Kenney, Los Angeles, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 15/912,529

(22) Filed: Mar. 5, 2018

(65) Prior Publication Data

US 2018/0253935 A1 Sep. 6, 2018

Related U.S. Application Data

(60) Provisional application No. 62/467,064, filed on Mar. 3, 2017.

(51) Int. Cl.
*G07F 17/32* (2006.01)

(52) U.S. Cl.
CPC ..... *G07F 17/3223* (2013.01); *G07F 17/3209* (2013.01); *G07F 17/3211* (2013.01); *G07F 17/3216* (2013.01); *G07F 17/3225* (2013.01); *G07F 17/3251* (2013.01)

(58) Field of Classification Search
None
See application file for complete search history.

(56) References Cited

U.S. PATENT DOCUMENTS

2013/0165234 A1* 6/2013 Hall ..... A63F 13/00 463/42
2015/0262450 A1* 9/2015 Elias ..... G07F 17/3262 463/25
2015/0298008 A1* 10/2015 Broom ..... A63F 13/795 463/25
2017/0154494 A1* 6/2017 Cire ..... G07F 17/3244

* cited by examiner

*Primary Examiner* — Ronald Laneau
(74) *Attorney, Agent, or Firm* — Frank Cire

(57) ABSTRACT

A social network wagering system is disclosed. The social network wagering system includes an electronic gaming subsystem and a social network proxy controller constructed to communicate with the electronic gaming subsystem. The social network proxy controller is constructed to receive wagering game state data from the electronic gaming subsystem, generate social network interactions based on the wagering game state data, and determine a social network game state using the social network interactions and the wagering game state data.

3 Claims, 16 Drawing Sheets

SOCIAL NETWORK WAGERING SYSTEM

FIELD OF THE INVENTION

Embodiments of the invention are generally related to data processing systems used in gaming. More particularly, the invention relates to the communication and processing of wagering data.

BACKGROUND

The gaming industry has traditionally developed electronic gaming machines (EGMs) that implement simple wagers. However, more complicated wagering processes need communication and processing systems that are better suited for implementing these more complicated wagering processes. Various aspects of embodiments of the invention meet such a need.

SUMMARY OF THE INVENTION

Systems and methods in accordance with embodiments of the invention provide a communication and data processing system constructed for a social network wagering system.

In an embodiment, a social network wagering system includes an electronic gaming subsystem and a social network proxy controller constructed to communicate with the electronic gaming subsystem. The social network proxy controller is constructed to receive wagering game state data from the electronic gaming subsystem, generate social network interactions based on the wagering game state data, and determine a social network game state using the social network interactions and the wagering game state data.

In various embodiments, the electronic gaming subsystem and the social network proxy controller are constructed from the same device.

In some embodiments, the social network proxy controller is further constructed to communicate with a social network controller.

In various embodiments, the electronic gaming subsystem is an electronic gaming machine further including an enclosure constructed to mount a user input device, a user output device, a credit input device, and a credit output device.

In an embodiment, the electronic gaming subsystem further includes a random number generator and the electronic gaming subsystem is further constructed to communicate with the credit input device to receive a credit input, credit a credit meter with credits based on the incoming credit data, receive a social network metagame state from the social network proxy controller, determine a wagering proposition based on the social network metagame state, determine a wagering proposition outcome for the wagering proposition, update the credit meter based on the wagering proposition outcome, and communicate with the credit output device to generate a credit output based on credits transferred off of the credit.

In an embodiment of the invention, a process controller operates as an interface between an interactive controller that determines skill outcomes and a wagering sub-controller that determines chance-based components. By virtue of this feature, the wagering sub-controller is isolated from the interactive controller allowing the interactive controller to operate in an unregulated environment while allowing the wagering sub-controller to operate in a regulated environment, thus providing for more efficient management of the operations of such a system.

In another embodiment of the invention, a single wagering sub-controller may provide services to two or more interactive controllers, thus allowing a social network wagering system to operate more efficiently over a large range of scaling.

In another embodiment of the invention, multiple types of interactive controllers using different operating systems may be interfaced to a single type of process controller without requiring customization of the process controller and/or the wagering sub-controller, thus improving the efficiency of the process controller and/or the wagering sub-controller by reducing complexity associated with maintaining separate process controllers and/or wagering sub-controllers for each type of interactive controller.

In another embodiment of the invention, an interactive controller may be provided as a user device under control of a user while maintaining the process controller in an environment under the control of a regulated operator of wagering equipment, thus providing for a more economical system as the regulated operator need not expend capital to purchase interactive controllers.

In another embodiment of the invention, data communicated between the controllers may be encrypted to increase security of the social network wagering system.

In another embodiment of the invention, a process controller isolates chance-based component logic and skill-based component logic as unregulated logic from a regulated wagering sub-controller, thus allowing errors in the skill-based component logic and/or chance-based component logic to be corrected, new skill-based component logic and/or chance-based component logic to be used, or modifications to be made to the skill-based component logic and/or chance-based component logic without a need for time-consuming regulatory approval.

In another embodiment of the invention, an interactive application may require extensive processing resources from an interactive controller leaving few processing resources for the functions performed by a process controller and/or a wagering sub-controller. By virtue of an architecture of some embodiments of the invention, processing loads may be distributed across multiple devices such that operations of the interactive controller may be dedicated to an interactive application and the processes of the process controller and/or wagering sub-controller are not burdened by the requirements of the interactive application.

In another embodiment of the invention, a social network wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like. In many such embodiments, one or more components of a social network wagering system are distributed in close proximity to each other and communicate using a local area network and/or a communication bus. In several embodiments, an interactive controller and a process controller of a social network wagering system are in a common location. In some embodiments, a process controller communicates with an external interactive controller. In various embodiments, these multiple controllers and sub-controllers can be constructed from or configured using a single device or a plurality of devices such that a social network wagering system is executed as a system in a virtualized space such as, but not limited to, where a wagering sub-controller and a process controller are large scale centralized servers and are operatively connected to distributed interactive controllers via a wide area network such as the Internet or a local area network. In such embodiments, the components of a social network wagering system may communicate using a networking protocol or other type of device-to-device communications protocol.

In another embodiment of the invention, an interactive controller is an interactive server acting as a host for managing head-to-head user interactions over a network of interactive sub-controllers connected to the interactive server using a communication link. The interactive server provides an environment where users can compete directly with one another and interact with other users.

DETAILED DESCRIPTION

Figure 1:
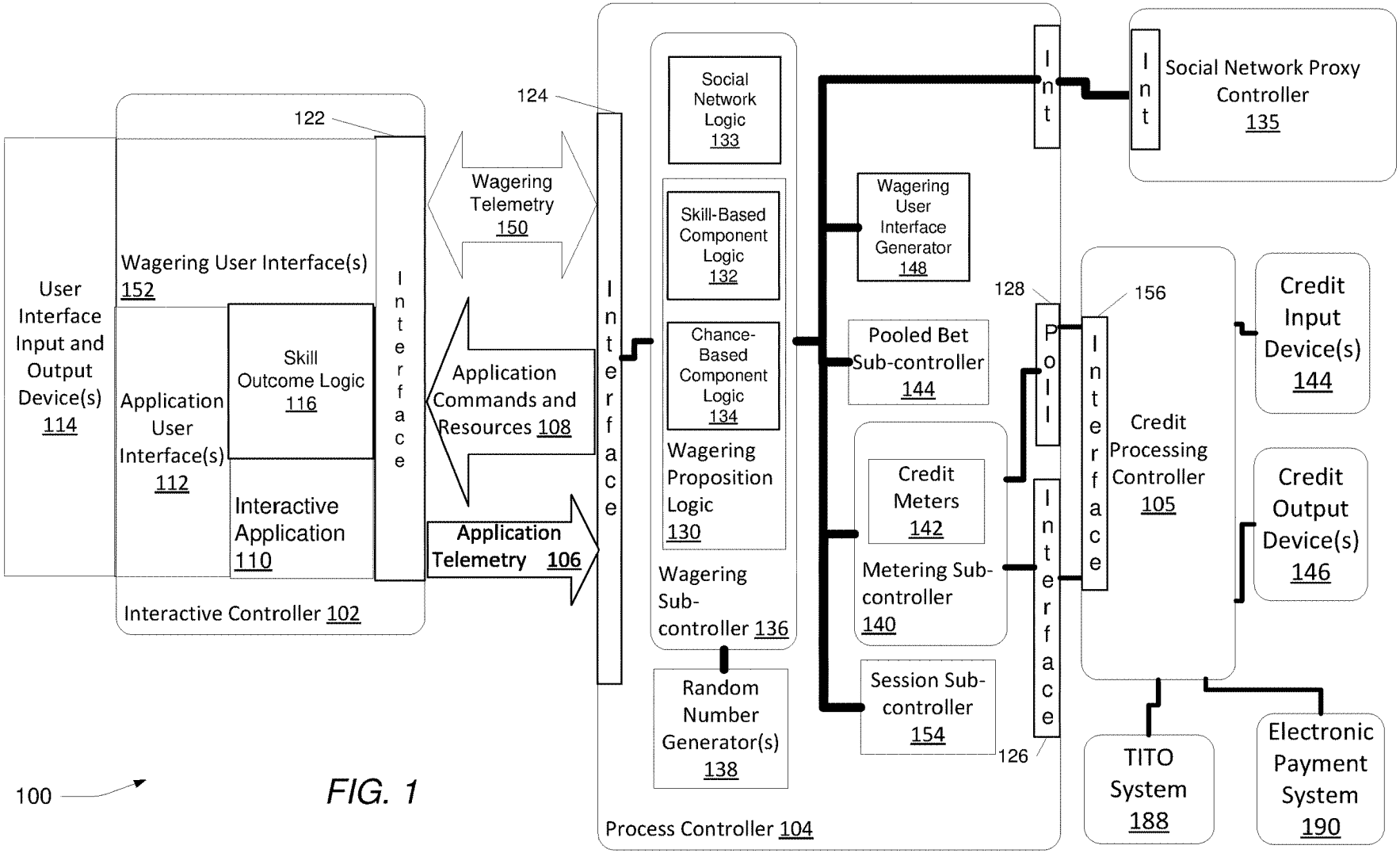
FIG. 1 is a diagram of a structure of a social network wagering system in accordance with various embodiments of the invention.

A social network wagering system allows for the management of a social network metagame for two or more users of a social network and a wagering proposition for one or more of the users. The wagering proposition may be composed of one or more skill-based components, one or more chance-based components, or a combination of both. In some embodiments of a social network wagering system, an interactive application executed by an interactive controller presents the wagering proposition to one or more of the users of the social network wagering system. The interactive controller is operatively connected to a process controller that manages and configures the interactive controller and the interactive application.

In some embodiments, the interactive controller also provides a wagering user interface that is used to receive commands and display data for the wagering proposition. The content of the wagering user interface is controlled by the process controller and includes content provided by a wagering sub-controller, the process controller and the interactive controller.

In various embodiments, an interactive controller provides a management user interface used to manage a user profile.

Many different types of interactive applications may be utilized with the social network wagering system. In some embodiments, the interactive application reacts to the physical activity of a user. In these embodiments, the interactive application senses user interactions with the interactive application through one or more sensors that monitor the user's physical activities. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors.

In some embodiments, the interactive application implements a skill-based game and interacts with the user by sensing skillful interactions with an interactive user interface generated by the interactive application.

In many embodiments, the interactive application generates various types of interactive elements in an interactive application environment. In some embodiments, these interactive elements are interactive application resources utilized within the interactive application environment to provide an interactive experience for a user.

In accordance with some embodiments, a chance-based component of the wagering proposition can influence interactive elements in the interactive application environment such as, but not limited to, automatically providing one or more new interactive elements, automatically restoring one or more consumed interactive elements, automatically causing the loss of one or more interactive elements, and automatic restoration or placement of one or more fixed interactive elements.

In various embodiments, wagers may be made using one or more credits.

In some embodiments, credits can be one or more credits that are purchased using, and redeemed in, a real world currency having a real world value.

In many embodiments, credits can be one or more credits in a virtual currency. Virtual currency is an alternate currency that can be acquired, purchased or transferred by or to a user, but does not necessarily directly correlate to a real world currency. In many such embodiments, credits in a virtual currency are allowed to be purchased using a real world currency but are prevented from being redeemed in a real world currency having a real world value. In several such embodiments, credits in a virtual currency are provided without consideration to a user, but the credits may be redeemed in a real world currency having a real world value.

In several embodiments, interaction with the interactive elements of the interactive application, application credits can be optionally consumed and/or accrued within the interactive application as a result of interaction with the interactive elements. Application credits can be in the form of, but not limited to, application environment credits, experience points, and points generally.

In various embodiments, application credits are awarded on the basis of skillful interactions with the interactive elements of a skill-based interactive application. The skill-based interactive application can have one or more scoring criteria, embedded within a process controller and/or an interactive controller that provides the skill-based interactive application, that can be used to determine user performance against one or more goals of the skill-based interactive application in accordance with a skill-based component.

In many embodiments, application credits can be used to purchase in-application items, including but not limited to, application interactive elements that have particular properties, power ups for existing items, and other item enhancements.

In some embodiments, application credits may be used to earn entrance into a sweepstakes drawing, to earn entrance in a tournament with prizes, to score in the tournament, and/or to participate and/or score in any other game event.

In several embodiments, application credits can be stored on a user-tracking card, voucher or in a network-based user tracking system where the application credits are attributed to a specific user.

In many embodiments, a wagering proposition includes a wager of application credits for payout of application credits, interactive application elements, and/or interactive application objects in accordance with the chance-based proposition.

In a number of embodiments, a wager of an amount of credits results in a payout of application credits, interactive elements, and/or interactive application objects that have a credit value if cashed out.

In some embodiments, interactive application objects include in-application objects that may be utilized to enhance user interactions with the interactive application. Such objects include, but are not limited to, power-ups, enhanced in-application items, and the like. In some embodiments, the interactive application objects include objects that are detrimental to user interactions with the interactive application such as, but not limited to, obstructions in the interactive application space, a temporary handicap, an enhanced opponent, and the like.

In numerous embodiments, an interactive application command is an instruction by a process controller to an interactive controller and/or an interactive application of the interactive controller to modify a state of an interactive application or modify one or more interactive application resources or interactive elements. In some embodiments, the interactive application commands may be automatically generated by the process controller using one or more of a chance-based component and/or application environment variables. An interactive application command can be used by a process controller control many processes of an interactive application, such as, but not limited to, an causing an addition of a period of time available for a current interactive application session for the interactive application, an addition of a period of time available for a future social network wagering system interactive application session or any other modification to the interactive application interactive elements that can be utilized during an interactive application session.

In some embodiments, asynchronous communications provided for by a social network wagering system may reduce an amount of idle waiting time by an interactive controller of the social network wagering system, thus increasing an amount of processing resources that the interactive controller may provide to an interactive application or other processes of the interactive controller. In many embodiments, asynchronous communications provided for by a social network wagering system reduces an amount of idle waiting time by a process controller, thus increasing an amount of processing resources that the process controller may provide to determine chance-based components, and other processes provided by the process controller.

In some embodiments, a wagering sub-controller of a social network wagering system may be operatively connected to a plurality of interactive controllers through a process controller and the asynchronous communications provided for by the process controllers allows the wagering sub-controller to operate more efficiently by providing chance-based components to a larger number of interactive controllers than would be achievable without the process controller of the social network wagering system.

In some embodiments, a social network wagering system including a process controller operatively connected to a wagering sub-controller and operatively connected to an interactive controller wherein the process controller provides for simplified communication protocols for communications of the interactive controller as the interactive controller may communicate interactions with an interactive application provided by the interactive controller to the process controller without regard to a nature of a chance-based proposition.

In various embodiments, a social network wagering system including a process controller operatively connected to a wagering sub-controller and operatively connected to an interactive controller may provide for simplified communication protocols for communications of the wagering sub-controller as the wagering sub-controller may receive chance-based component requests and communicate determined chance-based components without regard to a nature of an interactive application provided by the interactive controller.

In some embodiments, a social network wagering system including a process controller operatively connecting a wagering sub-controller to an interactive controller may provide for reduced processing requirement for the interactive controller by offloading the execution of a random number generator from the interactive controller to the process controller. In various such embodiments, additional processing resources may be made available to graphics processing or other processing intensive operations by the interactive controller because of the offloaded random number processing.

In various embodiments, a social network wagering system including a process controller operatively connecting a wagering sub-controller to an interactive controller provides for operation of the interactive controller in an unsecure location or manner, while providing for operation of the wagering sub-controller in a secure location or manner.

In some embodiments, a social network wagering system including a process controller operatively connecting a wagering sub-controller to an interactive controller allows the social network wagering system to have regulated components coupled to unregulated components in a heterogeneous regulated environment. For example, in several such embodiments, the interactive controller may be a device that is not regulated by a wagering regulatory agency whereas the wagering sub-controller is regulated by the wagering regulatory agency. A process controller of a social network wagering system may provide for isolation of the processing of the interactive controller from the processing of the wagering sub-controller. In such a heterogeneous regulatory environment, the process controller may or may not be itself a regulated by the wagering regulatory authority. In addition, components of an interactive application executed by the interactive controller may be either regulated or unregulated by the wagering regulatory agency.

Social Network Wagering Systems

FIG. 1 is a diagram of a structure of a social network wagering system in accordance with various embodiments of the invention. The social network wagering system 100 includes an interactive controller 102, a process controller 104, a credit processing controller 105, and a social network proxy controller 135. The interactive controller 102 is operatively connected to, and communicates with, the process controller 104. The process controller 104 is also operatively connected to, and communicates with, the credit processing controller 105. The process controller is operatively connected to, and communicates with, the social network proxy controller 135.

In various embodiments, the interactive controller 102 executes an interactive application 110 and provides one or more user interface input and output devices 114 so that one or more users can interact with the interactive application 110. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The interactive controller 102 provides for user interactions with the interactive application 110 by executing the interactive application 110 that generates an application user interface 112 that utilizes the user interface input devices to detect user interactions with the interactive controller 102 and generates an interactive user interface that is presented to the user utilizing the user interface output devices.

In some embodiments, one or more components an electronic gaming machine configuration of a social network wagering system are housed in an enclosure such as a housing, cabinet, casing or the like. The enclosure further includes one or more user accessible openings or surfaces that are constructed to mount the user interface input devices and/or the user interface output devices.

The interactive controller 102 is operatively connected to, and communicates with, the process controller 104. The interactive controller 102 receives application command and resource data 108 including wagering proposition data, application command data, and resource data, from the process controller 104. Via the communication of the application command and resource data 108, the process controller 104 can control the operation of the interactive controller 102 by communicating control parameters to the interactive application 110 during the interactive application's execution by the interactive controller 102.

In some embodiments, during execution of the interactive application 110 by the interactive controller 102, the interactive controller 102 communicates, as application telemetry data 106, user interactions with one or more interactive elements of the application user interfaces 112 of the interactive application to the process controller 104. the application telemetry data 106 may include, but is not limited to, application environment variables that indicate the state of the interactive application 110, interactive controller data indicating a state of the interactive controller 102, user actions and interactions between one or more users and the interactive application 110 provided by the interactive controller 102, and utilization of interactive elements in the interactive application 110 by one or more users.

In some embodiments, the application telemetry 106 includes a skill outcome as determined by the interactive application 110 using skill outcome logic 116, the application command and resource data 108, and user interactions with one or more application user interfaces 112 of the interactive application.

In some embodiments, the interactive application 110 is a skill-based interactive application. In such embodiments, execution of the skill-based interactive application 110 by the interactive controller 102 is based on one or more users' skillful interaction with the interactive application 110, such as, but not limited to, the users' utilization of the interactive elements of the interactive application during the users' skillful interaction with the skill-based interactive application. In such an embodiment, the process controller 104 communicates with the interactive controller 102 in order to allow the coupling of the skill-based interactive application to chance-based components determined in accordance with a chance-based proposition of the wagering sub-controller 136.

In some embodiments, the interactive application 110 uses skill-based component data, interactive application command data, and/or resource data included in the application commands and resources 108 to generate a wagering proposition having one or more skill-based components presented to one or more users as one or more application user interfaces 112 using one or more output devices of user interface and output device(s) 114. The one or more users skillfully interact with the one or more application user interfaces 112 using one or more of input devices of the user interface input and output devices 114. The interactive application 110 determines a skill outcome for the skill-based components of the wagering proposition based on the skillful interactions of the one or more users and communicates data of the determined skill outcome to the process controller 104 as part of the application telemetry 106. In some embodiments, the interactive application 110 also communicates as part of the application telemetry data 106, data encoding the one or more users' interactions with the interactive application 110.

In some embodiments, the skill outcome logic 116 and the skill-based component data included in the application commands and resources 108 are for a wagering proposition for one or more users. The interactive application 110 determines skill outcomes based on the skill-based component and the one or more users' skillful interactions with the interactive application. The skill outcomes are communicated by the interactive controller 102 to the process controller 104 included in the application telemetry 106.

In some embodiments, the interactive controller 102 includes one or more sensors that sense various aspects of the physical environment of the interactive controller 102. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data is communicated by the interactive controller to the process controller 104 as part of the application telemetry data 106.

The process controller 104 receives the sensor telemetry data and uses the sensor telemetry data to make wagering proposition decisions.

In many embodiments, the interactive controller 102 includes one or more wagering user interfaces 118 used to display wagering data, via one or more of the user interface input and output devices 114, to one or more users.

In various embodiments, an application control interface 122 resident in the interactive controller 102 provides an interface between the interactive controller 102 and the process controller 104.

In some embodiments, the application control interface 122 implements an interactive controller to process controller communication protocol employing an interprocess communication protocol so that the interactive controller and the process controller may be implemented on the same device. In operation, the application control interface 122 provides application programming interfaces that are used by the interactive application 110 of the interactive controller 102 to communicate outgoing data and receive incoming data by passing parameter data to another process or application.

In some embodiments, the application control interface 122 implements an interactive controller to process controller communication protocol employing an interdevice communication protocol so that the interactive controller and the process controller may be implemented on different devices. The interdevice protocol may utilize a wired communication bus or wireless connection as a physical layer.

In various embodiments, the application control interface 122 implements an interactive controller to process controller communication protocol employing a networking protocol so that the interactive controller and the process controller may be implemented on different devices connected by a network. The networking protocol may utilize a wired communication bus or wireless connection as a physical layer. In many such embodiments, the network includes a cellular telephone network or the like and the interactive controller is a mobile device such as a smartphone or other device capable of using the telephone network. During operation, the application control interface 122 communicates outgoing data to an external device by encoding the data into a signal and transmitting the signal to an external device. The application control interface receives incoming data from an external device by receiving a signal transmitted by the external device and decoding the signal to obtain the incoming data.

The process controller 104 provides an interface between a wagering proposition resolved for one or more users when interacting with the interactive application 110 provided by the interactive controller 102.

In various embodiments, the process controller 104 includes a wagering sub-controller 136 having a rule-based decision engine that receives application telemetry data 106 from the interactive controller 102. The rule-based decision engine has wagering proposition logic 130 including skill-based component logic 132 and chance-based component logic 134. The decision engine uses the application telemetry data 106, along with chance-based component logic 134, and a random outcome generated by one or more random number generators (RNGs) to generate a set of one or more chance-based components of a wagering proposition. The decision engine uses the application telemetry data 106, along with skill-based component logic 132, to generate a set of one or more skill-based components of a wagering proposition.

In an embodiment, the application telemetry data 106 used by the decision engine encodes data about the operation of the interactive application 110 executed by the interactive controller 102.

In some embodiments, the application telemetry data 106 encodes interactions of a user, such as a user's interaction with an interactive element of the interactive application 110.

In many embodiments, the application telemetry data 106 includes a state of the interactive application 110, such as values of variables that change as the interactive application 110 executes.

In several embodiments, the decision engine includes one or more rules as part of chance-based component logic 134 used by the decision engine 122 to determine how a chance-based component should generated. Each rule includes one or more variable values constituting a pattern that is to be matched by the wagering sub-controller 136 using the decision engine to one or more variable values encoded in the application telemetry data 106. Each rule also includes one or more actions that are to be taken if the pattern is matched. Actions can include automatically generating the chance-based component in accordance with the chance-based component logic 134 and a random outcome generated by one or more random number generators 138. During operation, the decision engine receives application telemetry data 106 from the interactive controller 102 via interface 160. The decision engine performs a matching process of matching the variable values encoded in the application telemetry data 106 to one or more variable patterns of one or more rules. If a match between the variable values and a pattern of a rule is determined, then the wagering controller 104 performs the action of the matched rule.

In some embodiments, the wagering sub-controller 136 uses the chance-based component in conjunction with the application telemetry data 106 and skill-based component logic 132, to automatically generate application command and resource data 108 including skill-based component data of a skill-based component of a wagering proposition that the process controller 104 communicates to the interactive controller 102 via interfaces 124 and 122.

In some embodiments, the decision engine includes one or more rules as part of skill-based component logic 132 used by the decision engine to automatically generate the application command and resource data 108 that is then communicated to the interactive controller 102. Each rule includes one or more variable values constituting a pattern that is to be matched to one or more variable values encoded in the application telemetry data 106 and the chance-based component. Each rule also includes one or more actions that are to be automatically taken by the wagering sub-controller 136 if the pattern is matched. Actions can include automatically generating skill-based component data, interactive application command data, and/or resource data 108 and using the skill-based component data, interactive application command data, and/or resource data 108 to control the interactive controller 102 to affect execution of the interactive application 110 as described herein. In operation, wagering sub-controller 104 uses the decision engine 122 to match the variable values encoded in the in the chance-based component data to one or more patterns of one or more rules of the skill-based component logic 132. If a match between the variable values and a pattern of a rule is found, then the process controller automatically performs the action of the matched rule. In some embodiments, the process controller 104 uses the application telemetry data 106 received from the interactive controller 102 in conjunction with the chance-based component to generate the skill-based component data, interactive application command data, and/or resource data 108.

The interactive controller receives the wagering proposition data, interactive application command data, and resource data 108 and automatically uses the skill-based component data, interactive application command data, and/or resource data 108 to configure and command the processes of the interactive application 110. In some embodiments, the wagering proposition data includes skill-based component data. In various embodiments, the wagering proposition data includes chance-based component data. In many embodiments, the wagering proposition data includes skill-based component data and chance-based component data.

In some embodiments, the interactive application 110 operates utilizing a scripting language. The interactive application 110 parses scripts written in the scripting language and executes commands encoded in the scripts and sets variable values as defined in the scripts. In operation of such embodiments, the process controller 104 automatically generates wagering proposition data, interactive application command data, and/or resource data 108 in the form of scripts written in the scripting language that are communicated to the interactive controller 102 during execution of the interactive application 110. The interactive controller 102 receives the scripts and passes them to the interactive application 110. The interactive application 110 receives the scripts, parses the scripts and automatically executes the commands and sets the variable values as encoded in the scripts.

In many embodiments, the interactive application 110 automatically performs processes as instructed by commands communicated from the process controller 104. The commands command the interactive application 110 to perform specified operations such as executing specified commands and/or setting the values of variables utilized by the interactive application 110. In operation of such embodiments, the process controller 104 automatically generates commands that are encoded into the wagering proposition data, interactive application command data, and/or resource data 108 that are communicated to the interactive controller 102. The interactive controller 102 passes the wagering proposition data, interactive application command data, and/or resource data 108 to the interactive application 110. The interactive application parses the wagering proposition data, interactive application command data, and/or resource data and automatically performs operations in accordance with the commands encoded in the skill-based component data, interactive application command data, and/or resource data 108.

In many embodiments, the process controller 104 includes a pseudo random or random result generator used to generate random results that are used by the decision engine to generate portions of the wagering proposition data, interactive application command data, and/or resource data 108.

In various embodiments, the process controller 104 includes one or more interfaces, 124, 126 and 128 that operatively connect the process controller 104 to one or more interactive controllers, such as interactive controller 102, and to one or more credit processing controllers, such as credit processing controller 105.

In some embodiments, one or more of the process controller interfaces implement a process controller to device or server communication protocol employing an interprocess communication protocol so that the process controller and one or more of a credit processing controller, an interactive controller, a wagering sub-controller, and/or a session sub-controller may be implemented on the same device. In operation, the process controller interfaces provide application programming interfaces or the like that are used by the process controller to communicate outgoing data and receive incoming data by passing parameter data to another process or application running on the same device.

In some embodiments, one or more of the process controller interfaces implement a process controller communication protocol employing an interdevice communication protocol so that the process controller may be implemented on a device separate from one or more credit processing controllers, one or more interactive controllers, one or more session sub-controllers and/or one or more wagering sub-controllers. The interdevice protocol may utilize a wired communication bus or wireless connection as a physical layer. In various embodiments, one or more of the process controller interfaces implement a process controller communication protocol employing a networking protocol so that the process controller may be operatively connected to one or more credit processing controllers, one or more interactive controllers, one or more session sub-controllers, and/or one or more wagering sub-controllers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more process controller interfaces communicate outgoing data to an external device or server by encoding the data into a signal and transmitting the signal to the external device or server. The one or more process controller interfaces receive incoming data from an external device or server by receiving a signal transmitted by the external device or server and decoding the signal to obtain the incoming data.

In several embodiments, the wagering sub-controller 136 is a controller for providing one or more wagers in accordance with one or more wagering propositions provided by the social network wagering system 100. Types of value of a wager can be one or more of several different types. Types of value of a wager can include, but are not limited to, a wager of an amount of credits corresponding to a real currency or a virtual currency, a wager of an amount of application credits earned through interaction with an interactive application, a wager of an amount of interactive elements of an interactive application, or a wager of an amount of objects used in an interactive application. A skill outcome determined for a wager in accordance with a skill-based component can increase or decrease an amount of the type of value used in the wager, such as, but not limited to, increasing or decreasing an amount of credits for a wager of credits. In various embodiments, a skill outcome determined for a wager in accordance with a skill-based component can increase or decrease an amount of a type of value that is different than a type of value of the wager, such as, but not limited to, increasing an amount of an object of an interactive application for a wager of credits.

In many embodiments, the process controller 104 includes one or more random number generators (RNGs) 138 for generating random outcomes. The wagering sub-controller uses the one or more random outcomes along with the chance-based component logic 130 to generate a set of one or more chance-based components of a wagering proposition.

In several embodiments, the process controller 104 includes a metering sub-controller 140 operatively connected to the credit processing controller 105 via interfaces 126 and 128. The metering sub-controller 140 communicates with the credit processing controller 105 to receive incoming credit data from the credit processing controller 105. The metering sub-controller 140 uses the incoming credit data to transfer credits into the social network wagering system and onto one or more credit meters 142. The metering sub-controller 140 communicates outgoing credit data to the credit processing controller 105 to transfer credits off of the one or more credit meters 142 and out of the social network wagering system.

In several embodiments, during operation, the metering sub-controller 140 communicates with the credit processing controller 105 to receive incoming credit data from the credit processing controller 105 and adds credits onto the one or more credit meters 110 at least partially on the basis of the incoming credit data. The one or more random number generators 138 execute processes that generate random results. The wagering sub-controller 136 uses the chance-based component logic 134 and the random results to generate a chance-based component of a wagering proposition. The wagering sub-controller uses the chance-based component along with the skill-based component logic 132 to generate a wagering proposition. Wagering proposition data is communicated by the process controller as part of the application command and resource data 108 to the interactive controller 102. The interactive application 110 uses the wagering proposition data along with the skill outcome logic 116 to generate a presentation for the user including the one or more user interfaces 112. One or more users interact with the one or more application user interfaces 112 through the one or more user interface input and output devices 114. The interactive application 110 determines a skill outcome based on the interactions of the one or more users and communicates data of the skill outcome as part of the application telemetry data 106 to the process controller 104. The wagering sub controller 136 receives the skill outcome data and determines a wager outcome for the wagering proposition based on the set of one or more chance-based components and the skill outcome and instructs the metering sub-controller 140 to add credits to, or deduct credits from, the one or more credit meters 110 based in part on the skill outcome data. For example, in some embodiments, the metering sub-controller is instructed to add an amount of credits to a credit meter of the one or more credit meters 110 when the skill outcome indicates a win for a user associated with the credit meter. In various embodiments, the metering sub-controller is instructed to deduct an amount of credits from the credit meter when the skill outcome indicates a loss for the user. At an end of a wagering session, the metering sub-controller 140 transfers credits off of the one or more credit meters 110 and out of the social network wagering system by communicating outgoing credit data to the credit processing controller 105.

In many embodiments, the one or more random number generators 138 generate random numbers by continuously generating pseudo random numbers using a pseudo random number generator. A most current pseudo random number is stored in a buffer thus constantly refreshing the buffer. In many embodiments, the buffer is refreshed at a rate exceeding 100 times per second. When the wagering sub-controller 136 requests a random result, the wagering sub-controller 136 receives the stored most current pseudo random number from the buffer. As timing between requests for a random result is not deterministic, the resulting output from the buffer is a random result such as a random number.

In some embodiments, a range of the value of a random number is mapped to one or more symbols representing one or more elements of a traditional chance-based proposition. In several such embodiments, a random number is mapped to a virtual card of a deck of virtual cards. In another such embodiment, the random number is mapped to a virtual face of a virtual die. In yet another such embodiment, the random number is mapped to symbol of a virtual reel strip on a virtual reel slot machine. In yet another such embodiment, the random number is mapped to a pocket of a virtual roulette wheel. In some embodiments, two or more random numbers are mapped to appropriate symbols to represent a completed chance-based proposition. In one such embodiment, two or more random numbers are mapped to faces of two or more virtual dice to simulate a random result generated by throwing two or more dice. In another such embodiment, multiple random numbers are mapped to virtual cards from a virtual deck of cards without replacement. In yet another such embodiment, two or more random numbers are mapped to two or more virtual reel strips to create stop positions for a virtual multi-reel slot machine.

In some embodiments, a wagering sub-controller determines a chance-based component and a skill-based component by executing proposition determination commands included in chance-based component logic and skill-based component logic that define processes of a wagering proposition where the proposition determination commands are formatted in a scripting language. In operation, a decision engine of a process controller generates the proposition determination commands in the form of a script written in the scripting language. The script includes the proposition determination commands that describe how the wagering sub-controller is to generate a skill-based component. The wagering sub-controller parses the script encoded in the skill-based component determination command data and executes the commands included in the script to generate the skill-based component.

In some embodiments, a wagering sub-controller determines a chance-based component and a skill-based component by executing proposition determination commands that define processes of the wagering user interface. In operation, a decision engine of a process controller generates the proposition determination commands. The wagering sub-controller receives the proposition determination commands and executes the proposition determination commands to generate the wagering proposition.

In various embodiments, the process controller 104 uses a rule-based decision engine to automatically determine an amount of application credits to award to a user based at least in part on the application telemetry data 106 including skill outcome data and user interaction data with the interactive application 110 of the social network wagering system. In numerous embodiments, the interactive application 110 is a skill-based interactive application and the application credits are awarded for a user's skillful interaction with the interactive application 110.

In some embodiments, the wagering sub-controller 136 uses a wagering user interface generator 148 to automatically generate wagering telemetry data 150 on the basis of amounts of credits on the one or more credit meters 142. The wagering telemetry data 150 is used by the process controller 104 to command the interactive controller 102 to automatically generate one or more wagering user interfaces 152 describing a state of wagered credit accumulation and loss for the social network wagering system. When a user interacts with the one or more wagering user interfaces 152, wagering user interface telemetry data 150 is generated by the one or more wagering user interfaces 152 and communicated by the interactive controller 102 to the process controller 104 using interfaces 122 and 124.

In some embodiments, the wagering telemetry data 150 may include, but is not limited to, amounts of application credits and interactive elements earned, lost or accumulated through interaction with the interactive application 110, and credits, application credits and interactive elements amounts won, lost or accumulated.

In some embodiments, the skill-based component data, interactive application command data, and/or resource data 108 are communicated to the wagering user interface generator 148 and used as a partial basis for generation of the wagering telemetry data 150 communicated to the interactive controller 102.

In various embodiments, the wagering user interface generator 148 also receives chance-based component data that is used as a partial basis for generation of the wagering telemetry data 150 communicated to the interactive controller 102. In some embodiments, the chance-based component data also includes data about one or more states of a wager of the wagering proposition as generated by the wagering sub-controller 136. In various such embodiments, the wagering user interface generator 148 generates a chance-based component generation process display and/or chance-based component state display using the one or more states of the chance-based component. The chance-based component generation process display and/or chance-based component state display is included in the wagering telemetry data 150 that is communicated to the interactive controller 102. The wagering process display and/or wagering state display is automatically displayed by the interactive controller 102 using the one or more wagering user interfaces 152. In other such embodiments, the one or more states of the chance-based component are communicated to the interactive controller 102 and the interactive controller 102 is instructed to automatically generate the chance-based component generation process display and/or chance-based component state display of the one or more wagering user interfaces 152 using the one or more states of the chance-based component for display.

In some embodiments, the chance-based component data includes state data about execution of a chance-based proposition of the chance-based component logic 134, including but not limited to a final state, intermediate state and/or beginning state of the chance-based proposition. For example, in a chance-based proposition that is based on slot machine math, the final state of the chance-based proposition may be reel positions, in a chance-based proposition that is based on roulette wheel math, the final state may be a pocket where a ball may have come to rest, in a chance-based proposition that is a based on card math, the beginning, intermediate and final states may represent a sequence of cards being drawn from a deck of cards, etc.

In some embodiments, an interactive controller generates a wagering user interface by executing commands that define processes of the wagering user interface where the commands are formatted in a scripting language. In operation, a wagering user interface generator of a process controller generates commands in the form of a script written in the scripting language. The script includes commands that describe how the interactive controller is to display wagering outcome data. The completed script is encoded as wagering telemetry data and communicated to the interactive controller by the process controller. The interactive controller receives the wagering telemetry data and parses the script encoded in the wagering telemetry data and executes the commands included in the script to generate the wagering user interface.

In many embodiments, an interactive controller generates a wagering user interface based on a document written in a document markup language that includes commands that define processes of the wagering user interface. In operation, a wagering user interface generator of a process controller generates a document composed in the document markup language. The document includes commands that describe how the interactive controller is to display wagering outcome data. The completed document is encoded as wagering telemetry data and communicated to the interactive controller by the process controller. The interactive controller receives the wagering telemetry data and parses the document encoded in the wagering telemetry data and executes the commands encoded into the document to generate the wagering user interface.

In some embodiments, an interactive controller generates a wagering user interface by executing commands that define processes of the wagering user interface. In operation, a wagering user interface generator of a process controller generates the commands and encodes the commands into wagering telemetry data that is communicated to the interactive controller by the process controller. The interactive controller receives the wagering telemetry data and executes the commands encoded in the wagering telemetry data to generate the wagering user interface.

In various embodiments, an interactive controller includes a data store of graphic and audio display resources that the interactive controller uses to generate a wagering user interface as described herein.

In many embodiments, a process controller communicates graphic and audio display resources as part of wagering telemetry data to an interactive controller. The interactive controller uses the graphic and audio display resources to generate a wagering user interface as described herein.

In many embodiments, the process controller 104 may additionally include various audit logs and activity meters.

The process controller 104 can further operatively connect to a metering sub-controller to determine an amount of credit or interactive elements available and other wagering metrics of a wagering proposition. Thus, the process controller 104 may potentially affect an amount of credits in play for participation in the wagering events of the wagering proposition provided by the wagering sub-controller. In some embodiments, the process controller 104 can also couple to a centralized server for exchanging various data related to users and the activities of the users during utilization of a social network wagering system.

In a number of embodiments, communication of chance-based component determination commands and skill-based component commands between the wagering sub-controller 136 and the process controller 104 can further be used to communicate various wagering control factors that the wagering sub-controller uses as input. Examples of wagering control factors include, but are not limited to, an amount of credits, amount of application credits, amount of interactive elements, or amounts of objects consumed wager, and/or a user's election to enter a jackpot round.

In many embodiments, two or more users can be engaged in using the interactive application 110 executed by the interactive controller 102. In various embodiments, a social network wagering system can include an interactive application 110 that provides a skill-based interactive application that includes head-to-head play between a single user and a computing device, between two or more users against one another, or multiple users playing against a computer device and/or each other. In some embodiments, the interactive application 110 can be a skill-based interactive application where the user is not skillfully playing against the computer or any other user such as skill-based interactive applications where the user is effectively skillfully playing against himself or herself.

In some embodiments, the process controller 104 utilizes the one or more wagering user interfaces 152 to communicate certain interactive application data to the user, including but not limited to, club points, user status, control of the selection of choices, and messages which a user can find useful in order to adjust the interactive application experience or understand the wagering status of the user.

In some embodiments, the process controller 104 utilizes the one or more wagering user interfaces 152 to communicate aspects of a wagering proposition to a user including, but not limited to, amount of credits, application credits, interactive elements, or objects in play, and amounts of credits, application credits, interactive elements, or objects available.

In a number of embodiments, the wagering sub-controller 136 can accept wagering proposition factors including, but not limited to, modifications in the amount of credits, application credits, interactive elements, or objects wagered on each individual wagering event, entrance into a bonus round, and other factors. In several embodiments, the process controller 104 can communicate a number of factors back and forth to the wagering sub-controller, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

In some embodiments, the process controller 104 includes a session sub-controller 154 is used to regulate a social network wagering system session. In various embodiments, the session sub-controller 154 includes one or more session sub-controller interfaces that operatively connect the session sub-controller 154 to one or more wagering sub-controllers, metering sub-controllers and pooled bet sub-controllers through their respective interfaces.

In some embodiments, one or more of the session sub-controller interfaces implement a session sub-controller to device or server communication protocol employing an interprocess communication protocol so that the session sub-controller and one or more of a credit processing controller, an interactive controller, a wagering sub-controller, and/or a process controller may be implemented on the same device. In operation, the session sub-controller interfaces provide application programming interfaces or the like that are used by the session sub-controller to communicate outgoing data and receive incoming data by passing parameter data to another process or application running on the same device.

In some embodiments, one or more of the session sub-controller interfaces implement a session sub-controller communication protocol employing an interdevice communication protocol so that the session sub-controller may be implemented on a device separate from one or more credit processing controllers, one or more interactive controllers, the one or more process controllers and/or the one or more wagering sub-controllers. The interdevice protocol may utilize a wired communication bus or wireless connection as a physical layer. In various embodiments, one or more of the session sub-controller interfaces implement a session sub-controller communication protocol employing a networking protocol so that the process session sub-controller may be operatively connected to the one or more credit processing controllers, the one or more interactive controllers, the one or more process controllers, and/or the one or more wagering sub-controllers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more session sub-controller interfaces communicate outgoing data to an external device or server by encoding the data into a signal and transmitting the signal to the external device or server. The one or more session sub-controller interfaces receive incoming data from an external device or server by receiving a signal transmitted by the external device or server and decoding the signal to obtain the incoming data.

In various embodiments, components of the process controller 104 communicate session data to the session sub-controller. The session data may include, but is not limited to, user data, interactive controller data, pooled bet and side bet data, process controller data and wagering sub-controller data used by the session sub-controller to regulate a social network wagering system session.

In some embodiments, the session sub-controller 154 may also assert control of a social network wagering system session by communicating session control data to components of the process controller 104. Such control may include, but is not limited to, commanding the process controller 104 to end a social network wagering system session, initiating wagering in a social network wagering system session, ending wagering in a social network wagering system session but not ending a user's use of the interactive application portion of the social network wagering system, and changing from real credit wagering in a social network wagering system to virtual credit wagering, or vice versa.

In many embodiments, the session sub-controller 154 manages user profiles for a plurality of users. The session sub-controller 154 stores and manages data about users in order to provide authentication and authorization of users of the social network wagering system 100. In some embodiments, the session sub-controller 154 also manages geolocation information to ensure that the social network wagering system 100 is only used by users in jurisdictions were wagering is approved. In various embodiments, the session sub-controller 154 stores application credits that are associated with the user's use of the interactive application of the social network wagering system 100.

In some embodiments, the session sub-controller 154 communicates user and session management data to the user using a management user interface (not shown) of the interactive controller. The user interacts with the management user interface and the management user interface generates management telemetry data that is communicated to the session sub-controller 154 via interfaces 122 and 124.

In some embodiments, the wagering sub-controller 136 communicates wagering session data to the session sub-controller 154. In various embodiments, the session sub-controller communicates wagering session control data to the wagering sub-controller 136.

In some embodiments, a process controller operates as an interface between an interactive controller and a wagering sub-controller. By virtue of this construction, the wagering sub-controller is isolated from the interactive controller allowing the interactive controller to operate in an unregulated environment while allowing the wagering sub-controller to operate in a regulated environment.

In some embodiments, a single wagering sub-controller may provide services to two or more interactive controllers and/or two or more process controllers, thus allowing a social network wagering system to operate over a large range of scaling.

In various embodiments, multiple types of interactive controllers using different operating systems may be interfaced to a single type of process controller and/or wagering sub-controller without requiring customization of the process controller and/or the wagering sub-controller.

In many embodiments, an interactive controller may be provided as a user device under control of a user while maintaining the wagering sub-controller in an environment under the control of a regulated operator of wagering equipment.

In several embodiments, data communicated between the controllers may be encrypted to increase security of the social network wagering system.

In some embodiments, a process controller isolates chance-based component logic and skill-based component logic as unregulated logic from a regulated wagering sub-controller, thus allowing errors in the skill-based component logic and/or chance-based component logic to be corrected, new skill-based component logic and/or chance-based component logic to be used, or modifications to be made to the skill-based component logic and/or chance-based component logic without a need for regulatory approval.

In various embodiments, an interactive application may require extensive processing resources from an interactive controller leaving few processing resources for the functions performed by a process controller and/or a wagering sub-controller. By virtue of the architecture described herein, processing loads may be distributed across multiple devices such that operations of the interactive controller may be dedicated to the interactive application and the processes of the process controller and/or wagering sub-controller are not burdened by the requirements of the interactive application.

In many embodiments, a social network wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of a social network wagering system are distributed in close proximity to each other and communicate using a local area network and/or a communication bus. In several embodiments, an interactive controller and a process controller of a social network wagering system are in a common location and communicate with an external wagering sub-controller. In some embodiments, a process controller and a wagering sub-controller of a social network wagering system are in a common location and communicate with an external interactive controller. In many embodiments, an interactive controller, a process controller, and a wagering sub-controller of a social network wagering system are located in a common location. In some embodiments, a session sub-controller is located in a common location with a process controller and/or a wagering sub-controller.

In various embodiments, these multiple devices can be constructed from or configured using a single device or a plurality of devices such that a social network wagering system is executed as a system in a virtualized space such as, but not limited to, where a wagering sub-controller and a process controller are large scale centralized servers in the cloud operatively connected to widely distributed interactive controllers via a wide area network such as the Internet or a local area network. In such embodiments, the components of a social network wagering system may communicate using a networking protocol or other type of device-to-device communications protocol.

In some embodiments, a social network wagering system is deployed over a local area network or a wide area network in an interactive configuration. An interactive configuration of a social network wagering system includes an interactive controller operatively connected by a network to a process controller and a wagering sub-controller.

In some embodiments, a social network wagering system is deployed over a local area network or a wide area network in a mobile configuration. A mobile configuration of a social network wagering system is useful for deployment over wireless communication network, such as a wireless local area network or a wireless telecommunications network. A mobile configuration of a social network wagering system includes an interactive controller operatively connected by a wireless network to a process controller and a wagering sub-controller.

In several embodiments, a centralized process controller is operatively connected to one or more interactive controllers and one or more wagering sub-controllers using a communication link. The centralized process controller can perform the functionality of a process controller across various social network wagering systems.

In numerous embodiments, an interactive application server provides a host for managing head-to-head play operating over a network of interactive controllers connected to the interactive application server using a communication link. The interactive application server provides an environment where users can compete directly with one another and interact with other users.

In many embodiments, the credit processing controller 105 operatively connects to one or more credit input devices for generating incoming credit data from a credit input. Credit inputs can include, but are not limited to, credit items used to transfer credits. The incoming credit data are communicated by the credit processing controller 105 to the metering sub-controller 140. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validator and/or coin validators that receive and validate paper and/or coin currency or tokens.

In various embodiments, the credit processing controller 105 includes one or more credit output devices 146 for generating a credit output based on outgoing credit data 192 communicated from the wagering sub-controller. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing controller 105 is operatively connected to, and communicates with, a TITO system or the like to determine incoming credit data representing amounts of credits to be transferred into the social network wagering system and to determine outgoing credit data representing amounts of credits to be transferred out of the social network wagering system. In operation, the credit processing controller 105 communicates with a connected credit input device, such as a bill validator/ticket scanner, used to scan a credit input in the form of a TITO ticket having indicia of credit account data of a credit account of the TITO system. The credit processing controller 105 communicates the credit account data to the TITO system. The TITO system uses the credit account data to determine an amount of credits to transfer to the credit processing controller 105, and thus to the metering sub-controller 140 of the process controller 104. The TITO system communicates the amount of credits to the credit processing controller 105. The credit processing controller 105 communicates the amount of credits as incoming credit data to the metering sub-controller 140 and the metering sub-controller 140 credits one or more credit meters 142 with the amount of credits so that the credits can be used when a user makes wagers using the social network wagering system 100.

In many embodiments, the credit processing controller 105 is operatively connected to a bill validator/ticket scanner as one of the one or more credit input devices 144. The credit processing controller 105 communicates with the bill validator/ticket scanner to scan currency used as a credit input to determine an amount of credits as incoming credit data to transfer credit to one or more credit meters 110 associated with one or more users. The skill metering sub-controller 140 credits the one or more credit meters 110 with the amount of credits so that the credits can be used when a user makes wagers using the social network wagering system 100.

In some embodiments, the credit processing controller 105 can use a TITO system 188 along with a ticket or voucher printer as one of the one or more credit output devices 146 to generate a TITO ticket as a credit output for a user. In operation, the credit processing controller 105 communicates, as outgoing credit data, data of an amount of credits to be credited to a credit account on the TITO system. The TITO system receives the amount of credits and creates the credit account and credits the credit account with the amount of credits. The TITO system generates credit account data for the credit account and communicates the credit account data to the credit processing controller 105. The credit processing controller 105 uses the ticket or voucher printer to print indicia of the credit account data onto a TITO ticket or voucher as a credit output.

In various embodiments, a credit processing interface 156 resident in the credit processing controller 105 provides an interface between the credit processing controller 156 and the process controller 104.

In some embodiments, the application control interface 122 implements a credit processing controller to process controller communication protocol employing an interprocess communication protocol so that the interactive controller 104 and the credit processing controller 105 may be implemented on the same device. In operation, the credit processing interface 156 provides application programming interfaces that are used by the credit processing controller 105 to communicate outgoing data and receive incoming data by passing parameter data to another process or application.

In some embodiments, the credit processing interface 156 implements an interactive controller to credit processing controller communication protocol employing an interdevice communication protocol so that the interactive controller and the credit processing controller may be implemented on different devices. The interdevice protocol may utilize a wired communication bus or wireless connection as a physical layer.

In various embodiments, the credit processing interface 156 implements an interactive controller to credit processing controller communication protocol employing a networking protocol so that the interactive controller 104 and the credit processing controller 105 may be implemented on different devices connected by a network. The networking protocol may utilize a wired communication bus or wireless connection as a physical layer. During operation, the credit processing interface 156 communicates outgoing data to an external device by encoding the data into a signal and transmitting the signal to an external device. The application control interface receives incoming data from an external device by receiving a signal transmitted by the external device and decoding the signal to obtain the incoming data.

In various embodiments, the credit processing controller 105 provides an interface to an electronic payment management system 190 such as an electronic wallet or the like. The electronic payment system provides credit account data that is used for generating incoming credit data as a credit input and outgoing credit data as a credit output.

In many embodiments, the process controller is operatively connected to an external session sub-controller (not shown). The external session sub-controller may provide session control for a wagering session or may provide services for management of a user account for the storage of user points, application credits and the like.

In some embodiments, the process controller is operatively connected to a central determination controller (not shown). In operation, when a wagering sub-controller of the process controller needs to determine a random result, the wagering sub-controller communicates a request to the central determination controller for the random result. The central determination controller receives the random result request and generates a random result in response to the random result request. The central determination controller communicates data of the random result to the process controller. The processing controller receives the data of the random result and utilizes the random result as described herein. In some embodiments, the random result is drawn from a pool of pre-determined random results.

In various embodiments, the wagering process sub-controller may be operatively connected to a progressive controller along (not shown) with one or more other process controllers of one or more other social network wagering systems. The progressive controller provides services for the collection and provision of credits used by the process controller to provide random results that have a progressive or pooling component.

In some embodiments, an interactive controller and a process controller are part of an electronic gaming subsystem. In various embodiments, a credit processing controller is also part of an electronic gaming subsystem. In some embodiments, a social network proxy controller is also a part of an electronic gaming subsystem.

Figure 2A:
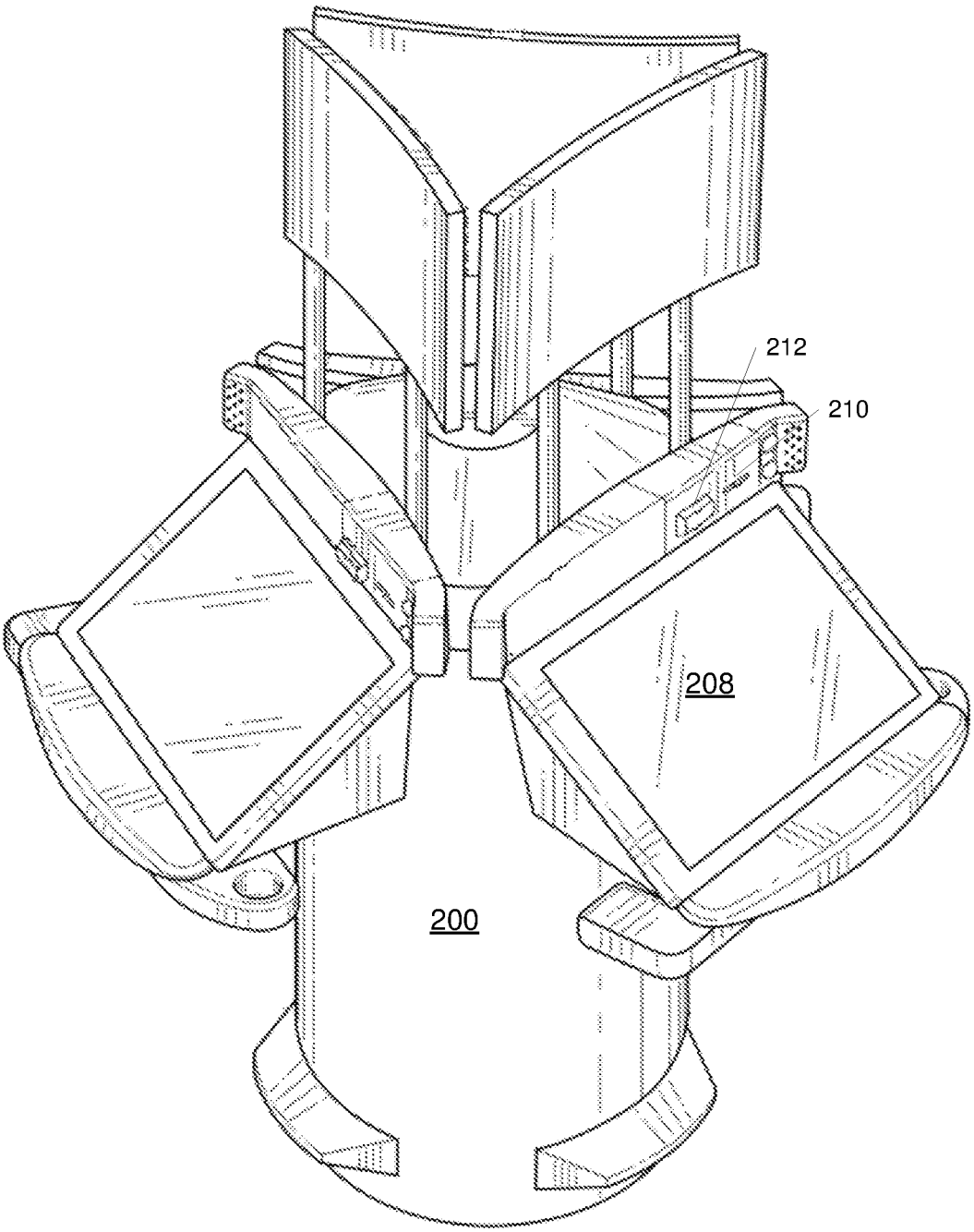
FIGS. 2A, 2B and 2C are diagrams of electronic gaming machine configurations of an electronic gaming subsystem of a social network wagering system in accordance with various embodiments of the invention.

FIG. 2A is a diagram of an electronic gaming machine configuration 200 of an electronic gaming subsystem of a social network wagering system in accordance with various embodiments of the invention. Electronic gaming machine configurations of an electronic gaming subsystem of a social network wagering system include, but are not limited to, electronic gaming machines such as slot machines, table games, video arcade consoles and the like. An electronic gaming machine configuration of a social network wagering system includes an interactive controller, a process controller and a credit processing controller included in an enclosure such as a housing, cabinet, casing or the like. The enclosure may further include one or more user accessible openings or surfaces that may be used to mount one or more user accessible user input devices and user output devices 208, one or more user accessible credit input devices 210 and one or more credit output devices 212. The interactive controller communicates with the user input devices to detect user interactions with the social network wagering system and commands and controls the user output devices to provide a user interface to one or more users of the social network wagering system as described herein. The process controller communicates with the credit processing controller or user credit processing devices 210 and 212 to transfer credits into and out of the social network wagering system as described herein.

Figure 2B:
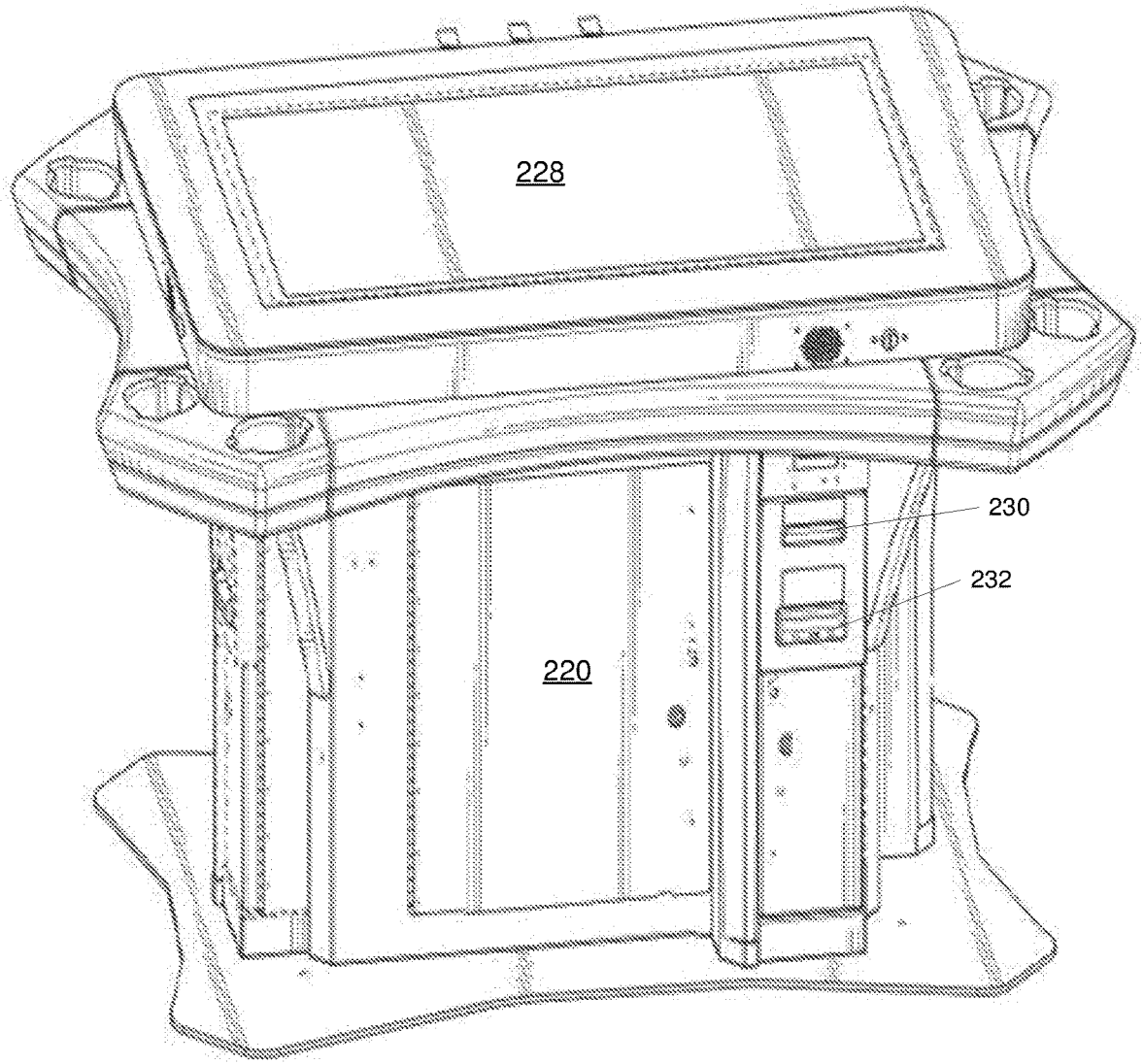

FIG. 2B is a diagram of multiuser electronic gaming machine configuration of an electronic gaming subsystem of a social network wagering system in accordance with various embodiments of the invention. Types of a multiuser electronic gaming machine configurations of a social network wagering system include, but are not limited to, multiuser electronic gaming machines, multiuser slot machines, multiuser table gaming devices, multi user video arcade consoles and the like. A multiuser electronic gaming machine configuration of a social network wagering system 220 includes an interactive controller, a process controller and a credit processing controller contained in an enclosure such as a housing, cabinet, casing or the like. The enclosure may further include one or more user accessible openings or surfaces that may be used to mount one or more user accessible user input devices and user output devices 228, one or more user accessible credit input devices 230 and one or more user accessible credit output devices 232.

In some embodiments, two or more sets of credit input devices and credit output devices are provided so that each user of the multiuser electronic gaming machine configuration of a social network wagering system 220 can have an associated set of credit input devices and credit output devices.

The interactive controller communicates with the user input devices to detect user interactions with the social network wagering system and commands and controls the user output devices to provide a user interface to one or more users of the social network wagering system as described herein. The process controller communicates with the credit processing controller or user credit processing devices 230 and 232 to transfer credits into and out of the social network wagering system as described herein.

Figure 2C:
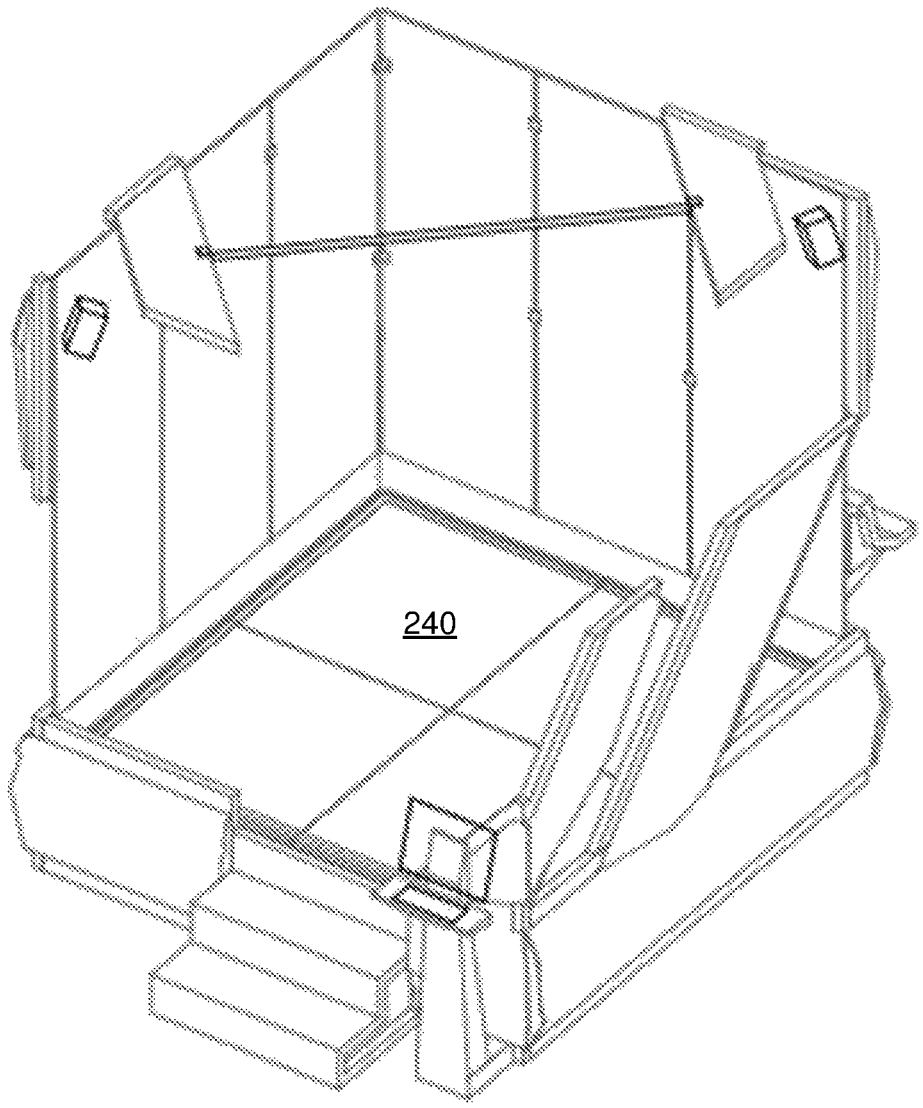

FIG. 2C is a diagram of virtual reality electronic gaming machine configuration of an electronic gaming subsystem of a social network wagering system in accordance with various embodiments of the invention. Types of virtual reality electronic gaming machine configurations of a social network wagering system include, but are not limited to, virtual reality electronic gaming machines, virtual reality slot machines, virtual reality table gaming devices, virtual reality video arcade consoles and the like. A virtual reality electronic gaming machine configuration of a social network wagering system 240 includes an interactive controller, a process controller and a credit processing controller contained in an enclosure such as a housing, cabinet, casing or the like. The enclosure may further include one or more user accessible openings or surfaces that may be used to mount one or more user accessible user input devices and user output devices 242, one or more user accessible credit input devices 244 and one or more user accessible credit output devices 246.

In some embodiments, two or more sets of credit input devices and credit output devices are provided so that each user of the virtual reality electronic gaming machine of a social network wagering system 240 can have an associated set of credit input devices and credit output devices.

The interactive controller communicates with the user input devices to detect user interactions with the social network wagering system and commands and controls the user output devices to provide a user interface to one or more users of the social network wagering system as described herein. The process controller communicates with the credit processing controller or user credit processing devices 244 and 246 to transfer credits into and out of the social network wagering system as described herein.

In various embodiments, an interactive controller may be constructed from or configured using one or more processing devices configured to perform the operations of the interactive controller. An interactive controller in a social network wagering system may be constructed from or configured using any processing device having sufficient processing and communication capabilities that may be configured to perform the processes of an interactive controller in accordance with various embodiments of the invention. In some embodiments, the construction or configuration of the interactive controller may be achieved through the use of an application control interface, such as application control interface and/or through the use of an interactive application.

In some embodiments, an interactive controller may be constructed from or configured using an electronic gaming machine. The electronic gaming machine may be physically located in various types of gaming establishments.

In many embodiments, an interactive controller may be constructed from or configured using a portable device. A portable device is any device that may wirelessly connect to a network. Examples of portable devices include, but are not limited to, a tablet computer, a personal digital assistant, and a smartphone.

In some embodiments, an interactive controller may be constructed from or configured using a gaming console.

In various embodiments, an interactive controller may be constructed from or configured using a personal computer.

In some embodiments, a single processing device may be used to construct an electronic gaming subsystem of a social network wagering system and may be operatively connected using a communication link to a social network proxy controller.

Some electronic gaming subsystems social network wagering systems in accordance with many embodiments of the invention can be distributed across a plurality of devices in various configurations. In an example embodiments, one or more interactive controllers of a distributed social network wagering system, such as but not limited to, a mobile or wireless device, a gaming console, a personal computer, and an electronic gaming machine, are operatively connected with a process controller of a distributed social network wagering system using a communication link. The communication link is a communications link that allows processing systems to communicate with each other and to share data. Examples of the communication link can include, but are not limited to: a wired or wireless interdevice communication link, a serial or parallel interdevice communication bus; a wired or wireless network such as a Local Area Network (LAN), a Wide Area Network (WAN), or the like; or a wired or wireless communication network such as a wireless telecommunications network or plain old telephone system (POTS). In some embodiments, one or more processes of an interactive controller and a process controller as described herein are executed on individual interactive controllers while one or more processes of a wagering sub-controller as described herein can be executed by the wagering sub-controller.

In many embodiments, a process controller of a distributed social network wagering system may be operatively connected using a communication link to a social network proxy controller.

In other embodiments, a number of other peripheral systems, such as a user management system, a gaming establishment management system, a regulatory system, and/or hosting servers are also operatively connected with the social network wagering systems using a communication link. Also, other servers can reside outside the bounds of a network within a firewall of the operator to provide additional services for network connected social network wagering systems.

Although various distributed social network wagering systems are described herein, social network wagering systems can be distributed in any configuration as appropriate to the specification of a specific application in accordance with various embodiments of the invention. In some embodiments, components of a distributed social network wagering system, such as a process controller, a wagering sub-controller, an interactive controller, or other servers that perform services for a process controller, wagering sub-controller and/or interactive controller, can be distributed in different configurations for a specific distributed social network wagering system application.

Figure 3A:
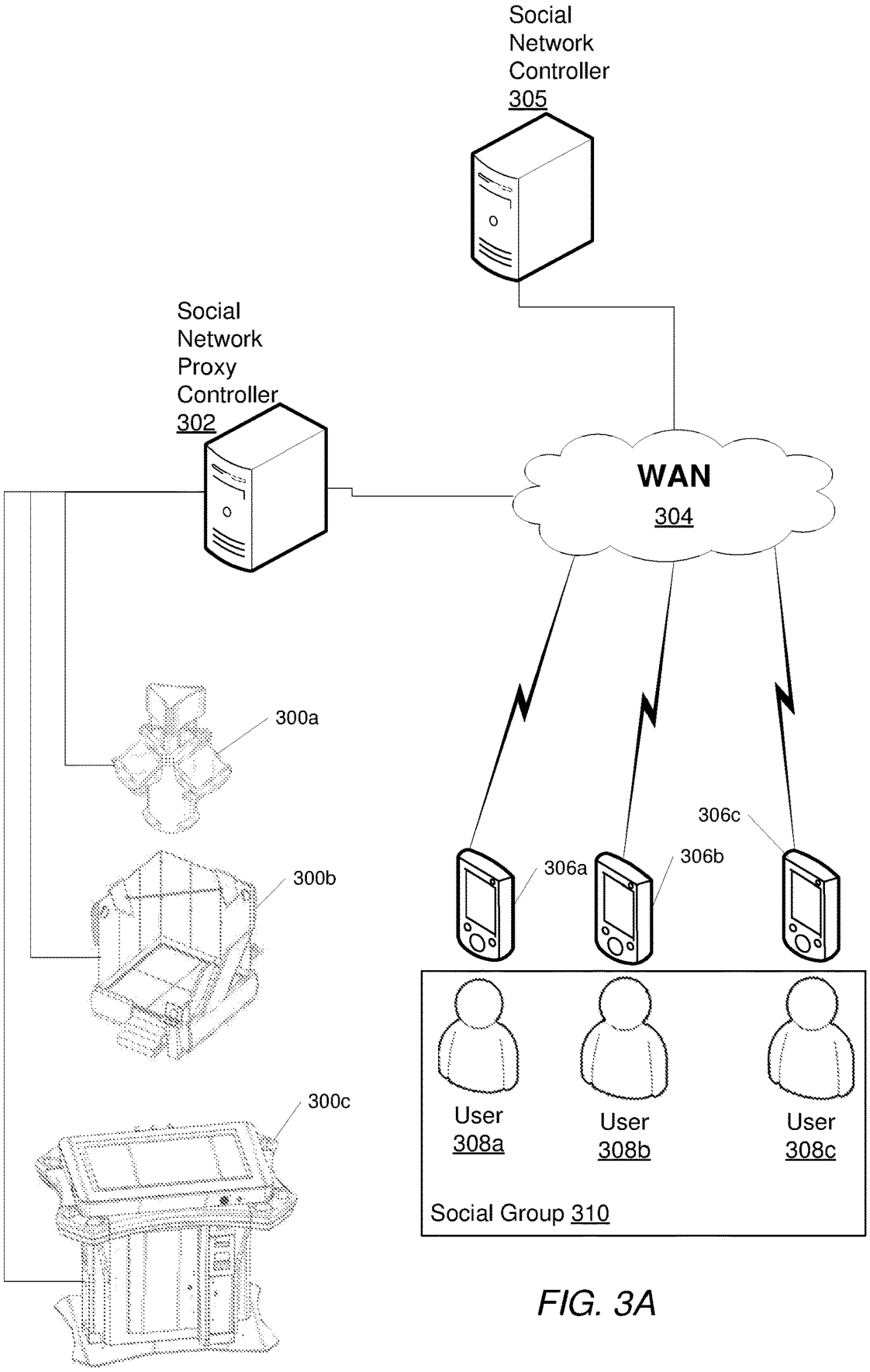
FIGS. 3A and 3B are diagrams of deployments of social network wagering systems in accordance with various embodiments of the invention.

FIG. 3A is a diagram of deployment of a social network wagering system in accordance with various embodiments of the invention. A deployment of a social network wagering system includes one or more electronic gaming subsystems, such as electronic gaming machines 300*a*, 300*b* and 300*c*, that are operatively connected to one or more social network proxy controllers, such as social network proxy controller 302.

In many embodiments, the one or more social network proxy controllers are operatively connected to a wide area network (WAN) 304, such as the Internet. The one or more social network proxy controllers are operatively connected to a social network controller 305 through the WAN.

In some embodiments, the one or more social network proxy controllers are operatively connected to a local area network (LAN). The one or more social network proxy controllers are operatively connected to a social network controller through the LAN.

The deployment of the social network wagering system further includes one or more user devices, such as user devices 306*a*, 306*b*, and 306*c*, that are operatively connected to the WAN. Example embodiments of user devices include, but are not limited to, smart phones, tablet computers, personal computers, laptop computers, or the like. The user devices are operable to provide one or more social network user interfaces respectively to one or more users, such as users 308*a*, 308*b* and 308*c*. The one or more users are included in a social group 310.

In operation, the users of the social group use one or more interactive wagering interactive applications having one or more wagering propositions that are presented on the electronic gaming machines. Simultaneously, the one or more electronic gaming machines communicate electronic gaming machine game state data to the social network proxy controller. The social network proxy controller receives the electronic gaming machine game state data and uses the electronic gaming machine game state data to generate electronic gaming machine game social network interactions with the social network controller. The one or more user devices provide a user interface for the one or more users to perceive the electronic gaming machine game social network interactions and respond to them. To do so, the user devices receive user inputs from the one or more users and generate user social network interactions with the social network controller that are responsive to the electronic gaming machine game social network interactions. The social network proxy controller monitors the user social network interactions and determines a social network metagame game state for a social network metagame based on the user social network interactions, electronic gaming machine game social network interactions, and the electronic gaming machine state data. The social network proxy controller communicates the social network metagame game state to the one or more electronic gaming machines. The one or more electronic gaming machines use the social network metagame game state to modify the one or more interactive wagering games on the electronic gaming machines that are being played by the one or more users.

Figure 3B:
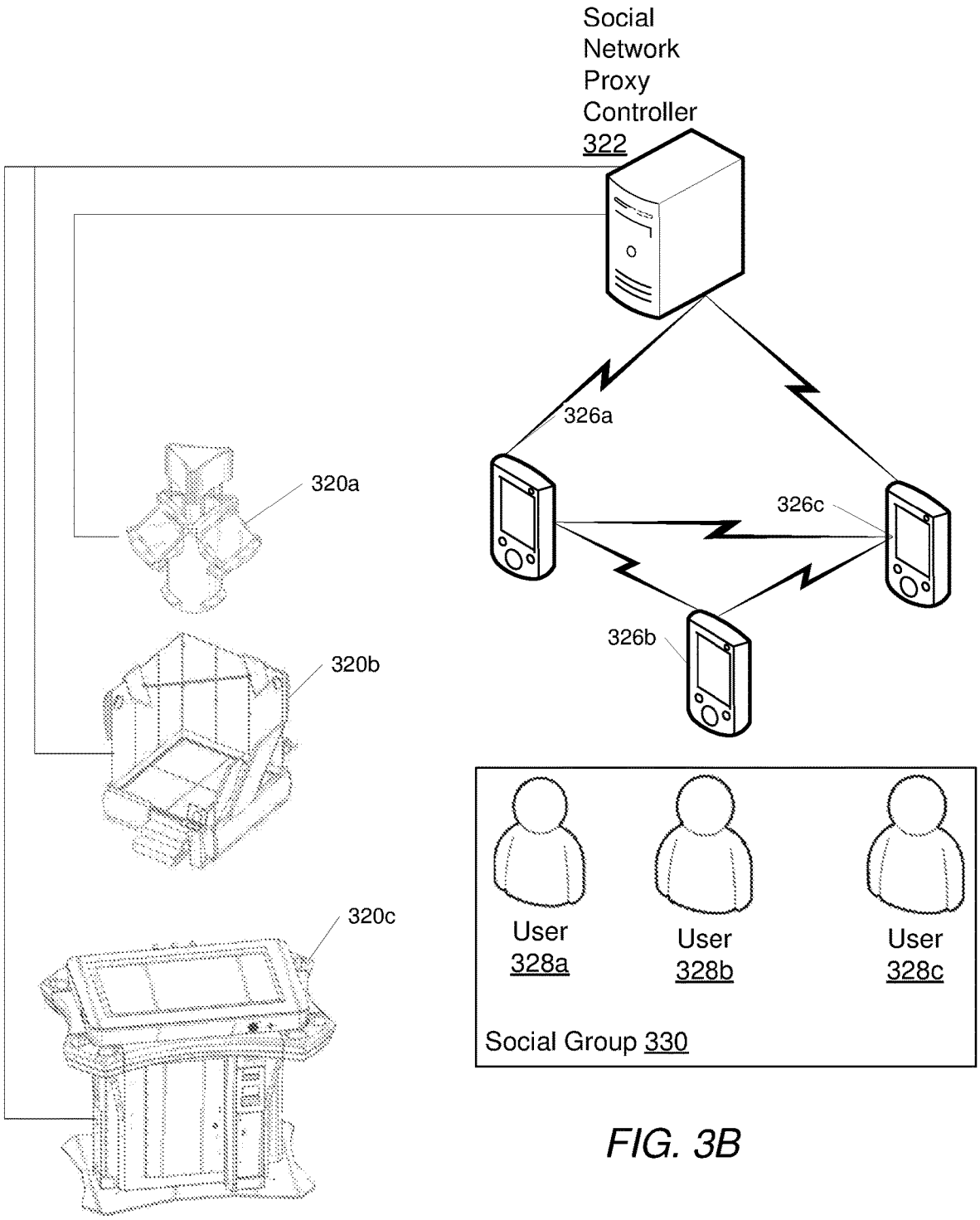

FIG. 3B is another diagram of a deployment of a social network wagering system in accordance with various embodiments of the invention. A deployment of a social network wagering system includes one or more electronic gaming subsystems, such as electronic gaming machines 320*a*, 320*b*, and 320*c*, that are operatively connected to one or more social network proxy controllers, such as social network proxy controller 322.

The social network wagering system further includes one or more user devices, such as user devices 326*a*, 326*b* and 326C, that are operatively connected to each other and the one or more social network proxy controllers through a peer-to-peer network. Example embodiments of user devices include, but are not limited to, smart phones, tablet computers, personal computers, laptop computers, or the like. The user devices are operable to provide one or more social network user interfaces respectively to one or more users, such as users 328*a*, 328*b*, and 328*c*. The one or more users are included in a social group 310.

In some embodiments, the peer-to-peer network is implemented over a WAN. In some embodiments, the peer-to-peer network is implemented over a LAN. In various embodiments, the peer-to-peer network is an ad hoc network of devices communicating using a short range wireless communication protocol such as Bluetooth or a near field communication (NFC) protocol.

In operation, the users of the social group use one or more interactive applications having one or more wagering propositions that are presented to the users on the electronic gaming machines. Simultaneously, the one or more electronic gaming machines communicate electronic gaming machine game state data to the one or more social network proxy controllers. The one or more social network proxy controllers receive the electronic gaming machine game state data and uses the electronic gaming machine game state data to generate electronic gaming machine game social network interactions with a social networking service hosted by the social network proxy controller. The one or more user devices provide a user interface for the one or more users to perceive the electronic gaming machine game social network interactions and respond to them. To do so, the user devices receive user inputs from the one or more users and generate user social network interactions with the social network service of the social network proxy controller that are responsive to the electronic gaming machine game social network interactions. The social network proxy controller monitors the user social network interactions and determines a social network metagame game state for a social network metagame based on the user social network interactions, electronic gaming machine game social network interactions, and the electronic gaming machine state data. The social network proxy controller communicates the social network metagame game state to the one or more electronic gaming machines. The one or more electronic gaming machines use the social network metagame game state to modify the one or more interactive wagering games on the electronic gaming machines that are being played by the one or more users.

Figure 4:
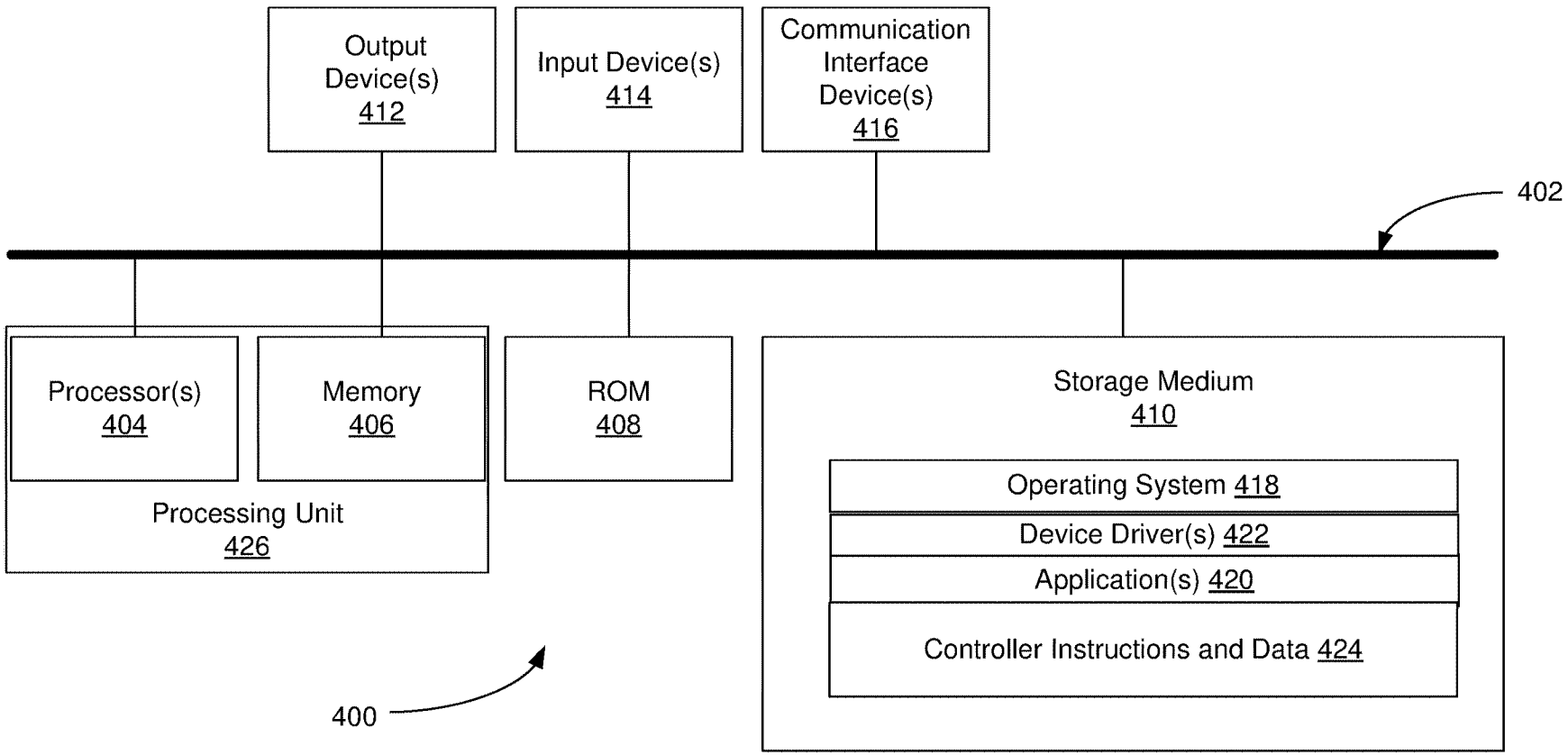
FIG. 4 is a structure diagram of an interactive controller of a social network wagering system in accordance with various embodiments of the invention.

FIG. 4 is a structure diagram an interactive controller of a social network wagering system in accordance with various embodiments of the invention. An interactive controller for a social network wagering system can be included in, constructed from, or configured using, various types of data processing devices including, but not limited to: a programmable controller; an electronic gaming device; a mobile device such as a smartphone or a personal digital assistant; a wireless portable device such as a tablet computer or the like; an electronic gaming machine such as a slot machine; a personal computer; a gaming console; a general purpose computer; a computing device; a server; a client; and the like.

Interactive controller 400 includes a bus 402 that provides an interface for one or more processors 404, random access memory (RAM) 406, read only memory (ROM) 408, machine-readable storage medium 410, one or more user output devices 412, one or more user input devices 414, and one or more communication interface devices 416.

The one or more processors 404 may take many forms, such as, but not limited to: a central processing unit (CPU); a multi-processor unit (MPU); an ARM processor; a controller; a programmable logic device; and the like.

In the example embodiment, the one or more processors 404 and the random access memory (RAM) 406 form an interactive controller processing unit 430. In some embodiments, the controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the controller processing unit is an ASIC (Application-Specific Integrated Circuit). In some embodiments, the controller processing unit is a SoC (System-on-Chip).

Examples of output devices 412 include, but are not limited to, touchscreens; video display screens; digital display screens; haptic touch sensors and video game controllers; light panels; lighted displays; or the like. In accordance with particular embodiments, the one or more processors 404 are operatively connected to audio output devices such as, but not limited to: buzzers; speakers; audio amplifiers; and the like. In accordance with many of these embodiments, the one or more processors 404 are operatively connected to tactile output devices such as vibrators; haptic manipulators; and the like.

Examples of user input devices 414 include, but are not limited to: tactile devices including but not limited to, keyboards, keypads, foot pads, touch screens, and/or trackballs; non-contact devices such as audio input devices; motion sensors and motion capture devices that the controller can use to receive inputs from a user when the user interacts with the controller; physiological sensors that monitor the physiology of the user; environmental sensors that monitor the physical environment of the controller; accelerometers that monitor changes in motion of the controller; location sensors that monitor the location of the controller such as global positioning sensors; and the like.

The one or more communication interface devices 416 provide one or more wired or wireless interfaces for communicating data and commands between the controller 400 and other devices that may be included in a social network wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 410 stores machine-executable instructions for various components of the interactive controller, such as but not limited to: an operating system 418; one or more device drivers 422; one or more application programs 420; and interactive controller instructions and data 424 for use by the one or more processors 404 to provide the features of an interactive controller as described herein.

In various embodiments, the machine-readable storage medium 410 is one of a (or a combination of two or more of) a hard drive, a flash drive, a DVD, a CD, a flash storage, a solid state drive, a ROM, an EIEPROM, and the like.

In operation, the machine-executable instructions are loaded into memory 406 from the machine-readable storage medium 410, the ROM 408 or any other storage location. The respective machine-executable instructions are accessed by the one or more processors 404 via the bus 402, and then executed by the one or more processors 404. Data used by the one or more processors 404 are also stored in memory 406, and the one or more processors 404 access such data during execution of the machine-executable instructions. Execution of the machine-executable instructions causes the one or more processors 404 to provide the features of an interactive controller as described herein.

Although the interactive controller is described herein as being constructed from or configured using one or more processors and instructions stored and executed by hardware components, the controller can be constructed from or configured using only hardware components in accordance with other embodiments. In addition, although the storage medium 410 is described as being operatively connected to the one or more processors through a bus, those skilled in the art of controllers will understand that the storage medium can include removable media such as, but not limited to, a USB memory device, an optical CD ROM, magnetic media such as tape and disks. In some embodiments, the storage medium 410 can be accessed by the one or more processors 404 through one of the communication interface devices 416 or using a communication link. Furthermore, any of the user input devices or user output devices can be operatively connected to the one or more processors 404 via one of the communication interface devices 416 using a communication link.

In some embodiments, the interactive controller 400 can be distributed across a plurality of different devices. In many such embodiments, an interactive controller of a social network wagering system includes an application server operatively connected to a client using a communication link. The application server and application client cooperate to provide the features of an interactive controller as described herein.

In various embodiments, the interactive controller 400 may be used to construct other components of a social network wagering system as described herein. In some embodiments, components of two or more of an interactive controller, a process controller, a credit processing controller, and a social network proxy controller, of a social network wagering system, may be constructed from or configured using a single device using processes that communicate using an interprocess communication protocol. In other such embodiments, the components of two or more controllers of a social network wagering system may communicate by passing messages, parameters or the like.

Figure 5:
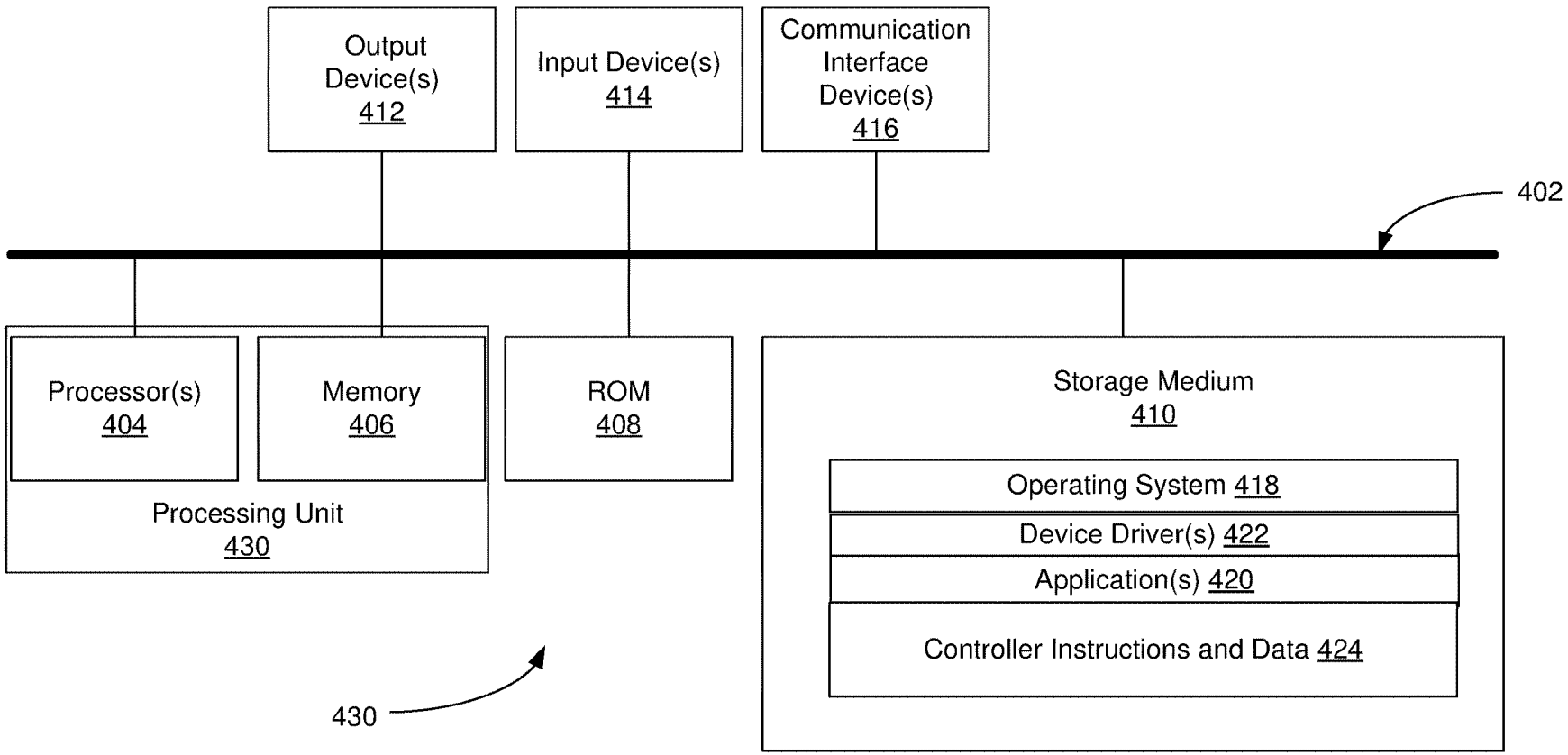
FIG. 5 is a structure diagram of a process controller of a social network wagering system in accordance with various embodiments of the invention.

FIG. 5 is a structure diagram a process controller of a social network wagering system in accordance with various embodiments of the invention. A process controller for a social network wagering system can be included in, constructed from, or configured using, various types of data processing devices including, but not limited to: a programmable controller; an electronic gaming device; a mobile device such as a smartphone or a personal digital assistant; a wireless portable device such as a tablet computer or the like; an electronic gaming machine such as a slot machine; a personal computer; a gaming console; a general purpose computer; a computing device; a server; a client; and the like.

Process controller 500 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; and the like.

In the example embodiment, the one or more processors 504 and the random access memory (RAM) 506 form a process controller processing unit 530. In some embodiments, the controller processing unit includes one or more processors operatively connected to one or more of a RAM, ROM, and machine-readable storage medium; the one or more processors of the process controller processing unit receive instructions stored by the one or more of a RAM, ROM, and machine-readable storage medium via a bus; and the one or more processors execute the received instructions. In some embodiments, the controller processing unit is an ASIC (Application-Specific Integrated Circuit). In some embodiments, the controller processing unit is a SoC (System-on-Chip).

Examples of output devices 512 include, but are not limited to, touchscreens; video display screens; digital display screens; haptic touch sensors and video game controllers; light panels; lighted displays; or the like. In accordance with particular embodiments, the one or more processors 504 are operatively connected to audio output devices such as, but not limited to: buzzers; speakers; audio amplifiers; and the like. In accordance with many of these embodiments, the one or more processors 504 are operatively connected to tactile output devices such as vibrators; haptic manipulators; and the like.

Examples of user input devices 514 include, but are not limited to: tactile devices including but not limited to, keyboards, keypads, foot pads, touch screens, and/or trackballs; non-contact devices such as audio input devices; motion sensors and motion capture devices that the controller can use to receive inputs from a user when the user interacts with the controller; physiological sensors that monitor the physiology of the user; environmental sensors that monitor the physical environment of the controller; accelerometers that monitor changes in motion of the controller; location sensors that monitor the location of the controller such as global positioning sensors; and the like.

The one or more communication interface devices 516 provide one or more wired or wireless interfaces for communicating data and commands between the controller 500 and other devices that may be included in a social network wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the process controller, such as but not limited to: an operating system 518; one or more device drivers 522; one or more application programs 520; and process controller instructions and data 524 for use by the one or more processors 504 to provide the features of a process controller as described herein.

In various embodiments, the machine-readable storage medium 510 is one of a (or a combination of two or more of) a hard drive, a flash drive, a DVD, a CD, a flash storage, a solid state drive, a ROM, an EIEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to provide the features of a process controller as described herein.

Although the process controller is described herein as being constructed from or configured using one or more processors and instructions stored and executed by hardware components, the controller can be constructed from or configured using only hardware components in accordance with other embodiments. In addition, although the storage medium 510 is described as being operatively connected to the one or more processors through a bus, those skilled in the art of controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 via one of the communication interface devices 516 using a communication link.

In some embodiments, the process controller 500 can be distributed across a plurality of different devices. In many such embodiments, a process controller of a social network wagering system includes an application server operatively connected to a client using a communication link. The application server and application client cooperate to provide the features of a process controller as described herein.

In various embodiments, the process controller 500 may be used to construct other components of a social network wagering system as described herein. In some embodiments, components of two or more of an interactive controller, a process controller, a credit processing controller, and a social network proxy controller, of a social network wagering system, may be constructed from or configured using a single device using processes that communicate using an interprocess communication protocol. In other such embodiments, the components of two or more controllers of a social network wagering system may communicate by passing messages, parameters or the like.

Figure 6:
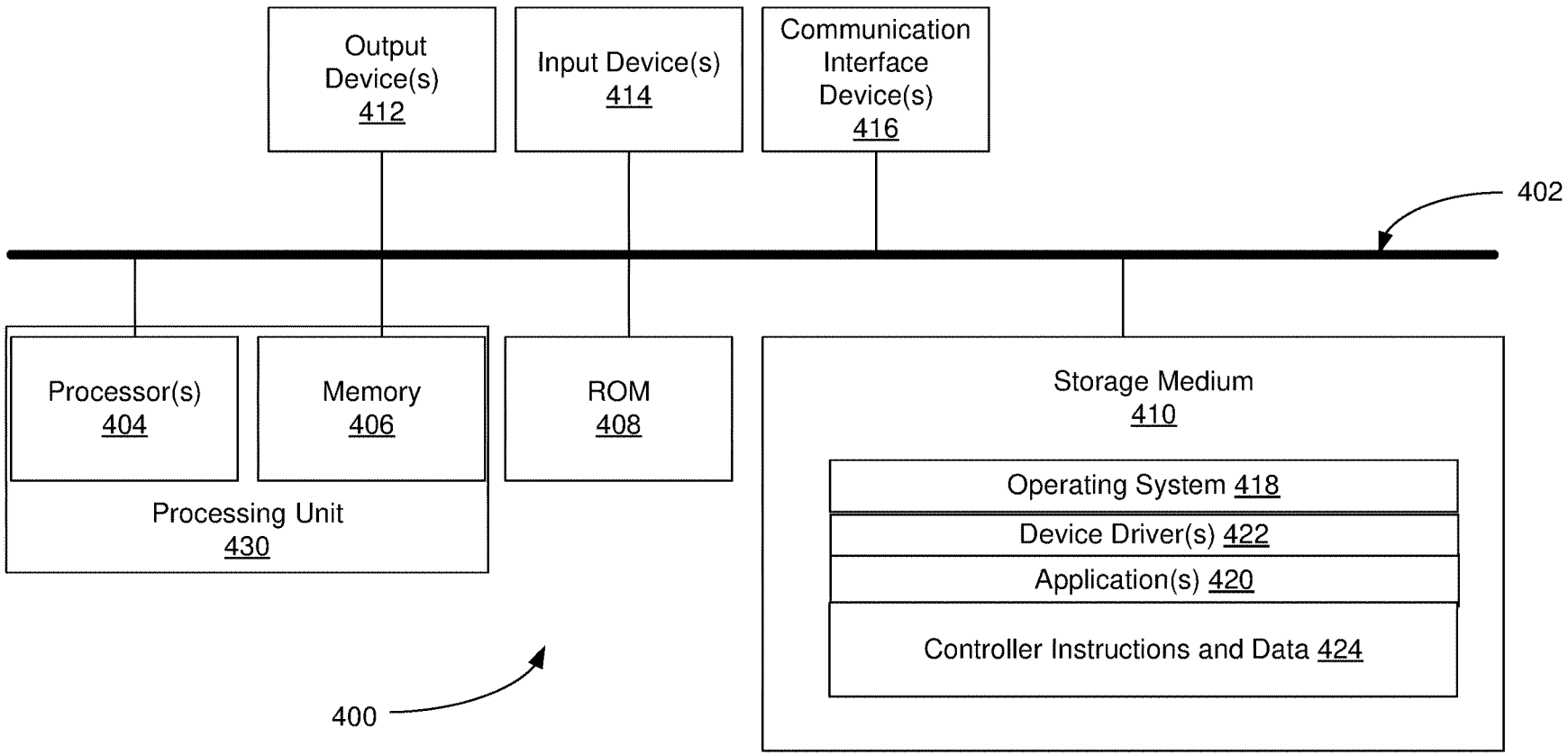
FIG. 6 is a structure diagram of a credit processing controller of a social network wagering system in accordance with various embodiments of the invention.

FIG. 6 is a structure diagram a credit processing controller of a social network wagering system in accordance with various embodiments of the invention. A credit processing controller for a social network wagering system can be included in, constructed from, or configured using, various types of data processing devices including, but not limited to: a programmable controller; an electronic gaming device; a mobile device such as a smartphone or a personal digital assistant; a wireless portable device such as a tablet computer or the like; an electronic gaming machine such as a slot machine; a personal computer; a gaming console; a general purpose computer; a computing device; a server; a client; and the like.

Credit processing controller 600 includes a bus 602 that provides an interface for one or more processors 604, random access memory (RAM) 606, read only memory (ROM) 608, machine-readable storage medium 610, one or more user output devices 612, one or more user input devices 614, and one or more communication interface devices 616.

The one or more processors 604 may take many forms, such as, but not limited to: a central processing unit (CPU); a multi-processor unit (MPU); an ARM processor; a controller; a programmable logic device; and the like.

In the example embodiment, the one or more processors 604 and the random access memory (RAM) 606 form a credit processing controller processing unit 630. In some embodiments, the controller processing unit includes one or more processors operatively connected to one or more of a RAM, ROM, and machine-readable storage medium; the one or more processors of the credit processing controller processing unit receive instructions stored by the one or more of a RAM, ROM, and machine-readable storage medium via a bus; and the one or more processors execute the received instructions. In some embodiments, the controller processing unit is an ASIC (Application-Specific Integrated Circuit). In some embodiments, the controller processing unit is a SoC (System-on-Chip).

Examples of output devices 612 include, but are not limited to, touchscreens; video display screens; digital display screens; haptic touch sensors and video game controllers; light panels; lighted displays; or the like. In accordance with particular embodiments, the one or more processors 604 are operatively connected to audio output devices such as, but not limited to: buzzers; speakers; audio amplifiers; and the like. In accordance with many of these embodiments, the one or more processors 604 are operatively connected to tactile output devices such as vibrators; haptic manipulators; and the like.

Examples of user input devices 614 include, but are not limited to: tactile devices including but not limited to, keyboards, keypads, foot pads, touch screens, and/or trackballs; non-contact devices such as audio input devices; motion sensors and motion capture devices that the controller can use to receive inputs from a user when the user interacts with the controller; physiological sensors that monitor the physiology of the user; environmental sensors that monitor the physical environment of the controller; accelerometers that monitor changes in motion of the controller; location sensors that monitor the location of the controller such as global positioning sensors; and the like.

The one or more communication interface devices 616 provide one or more wired or wireless interfaces for communicating data and commands between the controller 600 and other devices that may be included in a social network wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 610 stores machine-executable instructions for various components of the credit processing controller, such as but not limited to: an operating system 618; one or more device drivers 622; one or more application programs 620; and credit processing controller instructions and data 624 for use by the one or more processors 604 to provide the features of a credit processing controller as described herein.

In various embodiments, the machine-readable storage medium 610 is one of a (or a combination of two or more of) a hard drive, a flash drive, a DVD, a CD, a flash storage, a solid state drive, a ROM, an EIEPROM, and the like.

In operation, the machine-executable instructions are loaded into memory 606 from the machine-readable storage medium 610, the ROM 608 or any other storage location. The respective machine-executable instructions are accessed by the one or more processors 604 via the bus 602, and then executed by the one or more processors 604. Data used by the one or more processors 604 are also stored in memory 606, and the one or more processors 604 access such data during execution of the machine-executable instructions. Execution of the machine-executable instructions causes the one or more processors 604 to provide the features of a credit processing controller as described herein.

Although the credit processing controller is described herein as being constructed from or configured using one or more processors and instructions stored and executed by hardware components, the controller can be constructed from or configured using only hardware components in accordance with other embodiments. In addition, although the storage medium 610 is described as being operatively connected to the one or more processors through a bus, those skilled in the art of controllers will understand that the storage medium can include removable media such as, but not limited to, a USB memory device, an optical CD ROM, magnetic media such as tape and disks. In some embodiments, the storage medium 610 can be accessed by the one or more processors 604 through one of the communication interface devices 616 or using a communication link. Furthermore, any of the user input devices or user output devices can be operatively connected to the one or more processors 604 via one of the communication interface devices 616 using a communication link.

In some embodiments, the credit processing controller 600 can be distributed across a plurality of different devices. In many such embodiments, a credit processing controller of a social network wagering system includes an application server operatively connected to a client using a communication link. The application server and application client cooperate to provide the features of a credit processing controller as described herein.

In various embodiments, the credit processing controller 600 may be used to construct other components of a social network wagering system as described herein. In some embodiments, components of two or more of an interactive controller, a process controller, a credit processing controller, and a social network proxy controller, of a social network wagering system, may be constructed from or configured using a single device using processes that communicate using an interprocess communication protocol. In other such embodiments, the components of two or more controllers of a social network wagering system may communicate by passing messages, parameters or the like.

Figure 7:
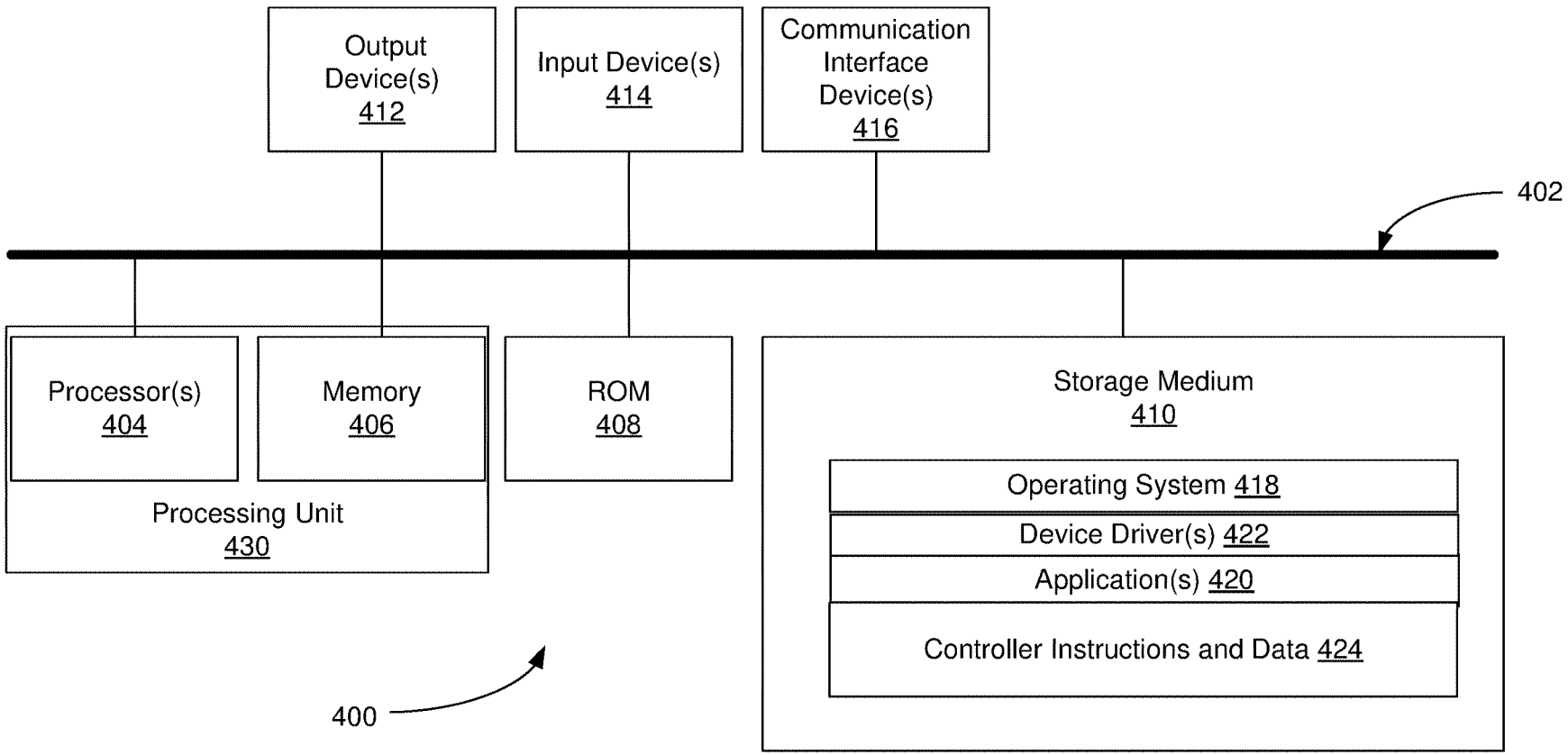
FIG. 7 is a structure diagram of a social network proxy controller of a social network wagering system in accordance with various embodiments of the invention.

FIG. 7 is a structure diagram a social network proxy controller of a social network wagering system in accordance with various embodiments of the invention. A social network proxy controller for a social network wagering system can be included in, constructed from, or configured using, various types of data processing devices including, but not limited to: a programmable controller; an electronic gaming device; a mobile device such as a smartphone or a personal digital assistant; a wireless portable device such as a tablet computer or the like; an electronic gaming machine such as a slot machine; a personal computer; a gaming console; a general purpose computer; a computing device; a server; a client; and the like.

Social network proxy controller 700 includes a bus 702 that provides an interface for one or more processors 704, random access memory (RAM) 706, read only memory (ROM) 708, machine-readable storage medium 710, one or more user output devices 712, one or more user input devices 714, and one or more communication interface devices 716.

The one or more processors 704 may take many forms, such as, but not limited to: a central processing unit (CPU); a multi-processor unit (MPU); an ARM processor; a controller; a programmable logic device; and the like.

In the example embodiment, the one or more processors 704 and the random access memory (RAM) 706 form a social network proxy controller processing unit 730. In some embodiments, the controller processing unit includes one or more processors operatively connected to one or more of a RAM, ROM, and machine-readable storage medium; the one or more processors of the social network proxy controller processing unit receive instructions stored by the one or more of a RAM, ROM, and machine-readable storage medium via a bus; and the one or more processors execute the received instructions. In some embodiments, the controller processing unit is an ASIC (Application-Specific Integrated Circuit). In some embodiments, the controller processing unit is a SoC (System-on-Chip).

Examples of output devices 712 include, but are not limited to, touchscreens; video display screens; digital display screens; haptic touch sensors and video game controllers; light panels; lighted displays; or the like. In accordance with particular embodiments, the one or more processors 704 are operatively connected to audio output devices such as, but not limited to: buzzers; speakers; audio amplifiers; and the like. In accordance with many of these embodiments, the one or more processors 704 are operatively connected to tactile output devices such as vibrators; haptic manipulators; and the like.

Examples of user input devices 714 include, but are not limited to: tactile devices including but not limited to, keyboards, keypads, foot pads, touch screens, and/or trackballs; non-contact devices such as audio input devices; motion sensors and motion capture devices that the controller can use to receive inputs from a user when the user interacts with the controller; physiological sensors that monitor the physiology of the user; environmental sensors that monitor the physical environment of the controller; accelerometers that monitor changes in motion of the controller; location sensors that monitor the location of the controller such as global positioning sensors; and the like.

The one or more communication interface devices 716 provide one or more wired or wireless interfaces for communicating data and commands between the controller 700 and other devices that may be included in a social network wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 710 stores machine-executable instructions for various components of the social network proxy controller, such as but not limited to: an operating system 718; one or more device drivers 722; one or more application programs 720; and social network proxy controller instructions and data 724 for use by the one or more processors 704 to provide the features of a social network proxy controller as described herein.

In various embodiments, the machine-readable storage medium 710 is one of a (or a combination of two or more of) a hard drive, a flash drive, a DVD, a CD, a flash storage, a solid state drive, a ROM, an EIEPROM, and the like.

In operation, the machine-executable instructions are loaded into memory 706 from the machine-readable storage medium 710, the ROM 708 or any other storage location. The respective machine-executable instructions are accessed by the one or more processors 704 via the bus 702, and then executed by the one or more processors 704. Data used by the one or more processors 704 are also stored in memory 706, and the one or more processors 704 access such data during execution of the machine-executable instructions. Execution of the machine-executable instructions causes the one or more processors 704 to provide the features of a social network proxy controller as described herein.

Although the social network proxy controller is described herein as being constructed from or configured using one or more processors and instructions stored and executed by hardware components, the controller can be constructed from or configured using only hardware components in accordance with other embodiments. In addition, although the storage medium 710 is described as being operatively connected to the one or more processors through a bus, those skilled in the art of controllers will understand that the storage medium can include removable media such as, but not limited to, a USB memory device, an optical CD ROM, magnetic media such as tape and disks. In some embodiments, the storage medium 710 can be accessed by the one or more processors 704 through one of the communication interface devices 716 or using a communication link. Furthermore, any of the user input devices or user output devices can be operatively connected to the one or more processors 704 via one of the communication interface devices 716 using a communication link.

In some embodiments, the social network proxy controller 700 can be distributed across a plurality of different devices. In many such embodiments, a social network proxy controller of a social network wagering system includes an application server operatively connected to a client using a communication link. The application server and application client cooperate to provide the features of a social network proxy controller as described herein.

In various embodiments, the social network proxy controller 700 may be used to construct other components of a social network wagering system as described herein. In some embodiments, components of two or more of an interactive controller, a process controller, a credit processing controller, and a social network proxy controller, of a social network wagering system, may be constructed from or configured using a single device using processes that communicate using an interprocess communication protocol. In other such embodiments, the components of two or more controllers of a social network wagering system may communicate by passing messages, parameters or the like.

Figure 8A:
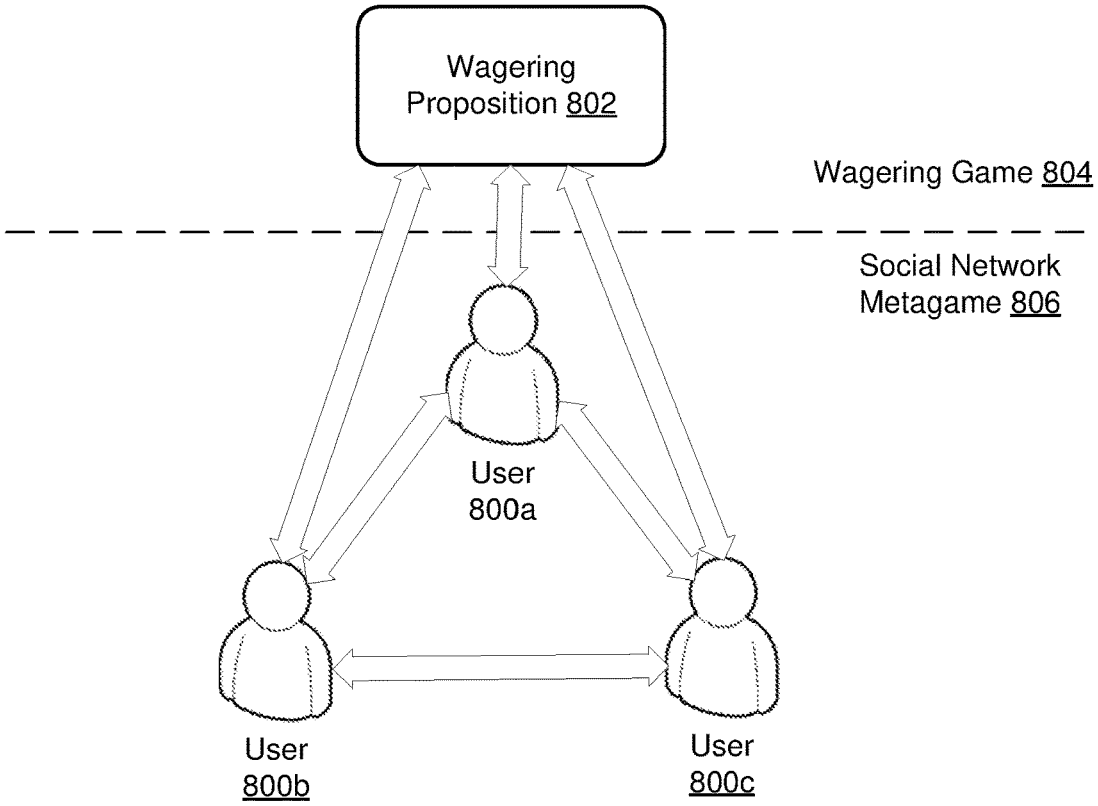
FIGS. 8A, 8B, 8C and 8D are diagrams of social network interactions for social network wagering systems in accordance with various embodiments of the invention.

FIGS. 8A, 8B, 8C and 8D are block diagrams illustrating social network interactions for a social network wagering system in accordance with various embodiments of the invention. Referring now to FIG. 8A, a social network includes a group of users, such as users 800*a*, 800*b*, and 800*c*, who interact with each other within a group. Their interactions are in accordance with a set of rules that constitute a social network metagame 806 of a social network wagering system. Two or more members of the group also interact with a group wagering proposition 802 of a wagering game 804 being provided by the social network wagering system. In some embodiments, events that occur during the social network metagame affect the wagering proposition of the wagering game. In some embodiments, events that occur during the wagering game affect the social network metagame.

Figure 8B:
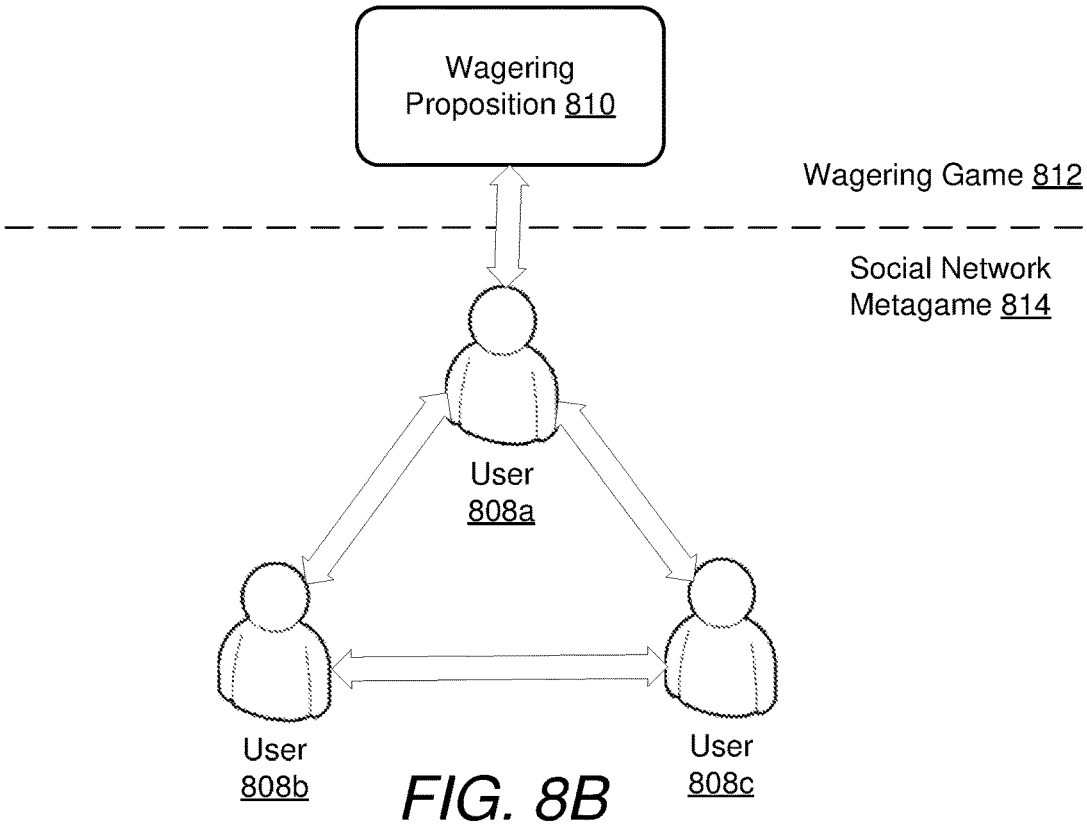

Referring now to FIG. 8B, a social network includes a group of users, such as users 808*a*, 808*b*, and 808*c*, who interact with each other. Their interactions are in accordance with a set of rules that constitute a social network metagame 814 of a social network wagering system. One member of the group also interacts with a wagering proposition 810 of a wagering game 812 being provided by the social network wagering system. In some embodiments, events that occur during the social network metagame affect the wagering proposition of the wagering game. In some embodiments, events that occur during the wagering game affect the social network metagame.

Figure 8C:
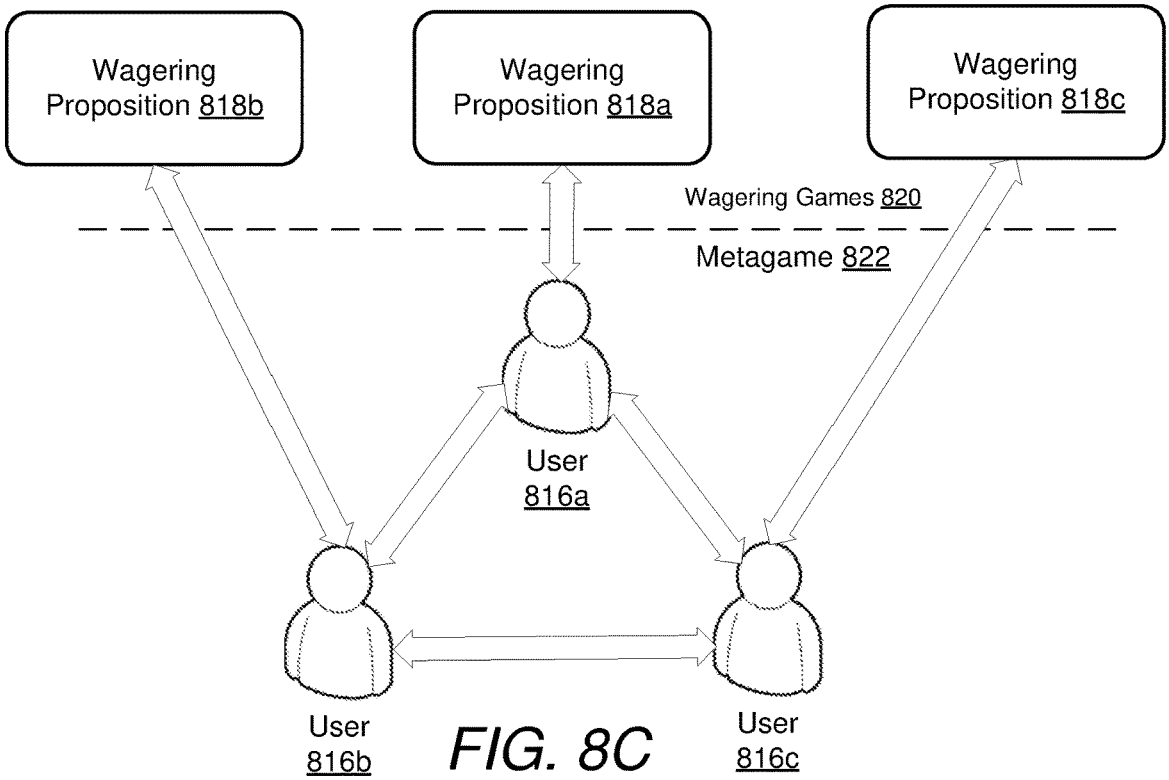

Referring now to FIG. 8C, a social network includes a group of users, such as users 816*a*, 816*b*, and 816*c*, who interact with each other. Their interactions are in accordance with a set of rules that constitute a social network metagame 822 of a social network wagering system. Two or more members of the group also interact with two or more respective wagering propositions, such as wagering propositions 818*a*, 818*b*, and 818*c* of two or more wagering games 820 being provided by the social network wagering system. In some embodiments, events that occur during the social network metagame affect the wagering proposition of the wagering games. In some embodiments, events that occur during the wagering games affect the social network metagame.

Figure 8D:
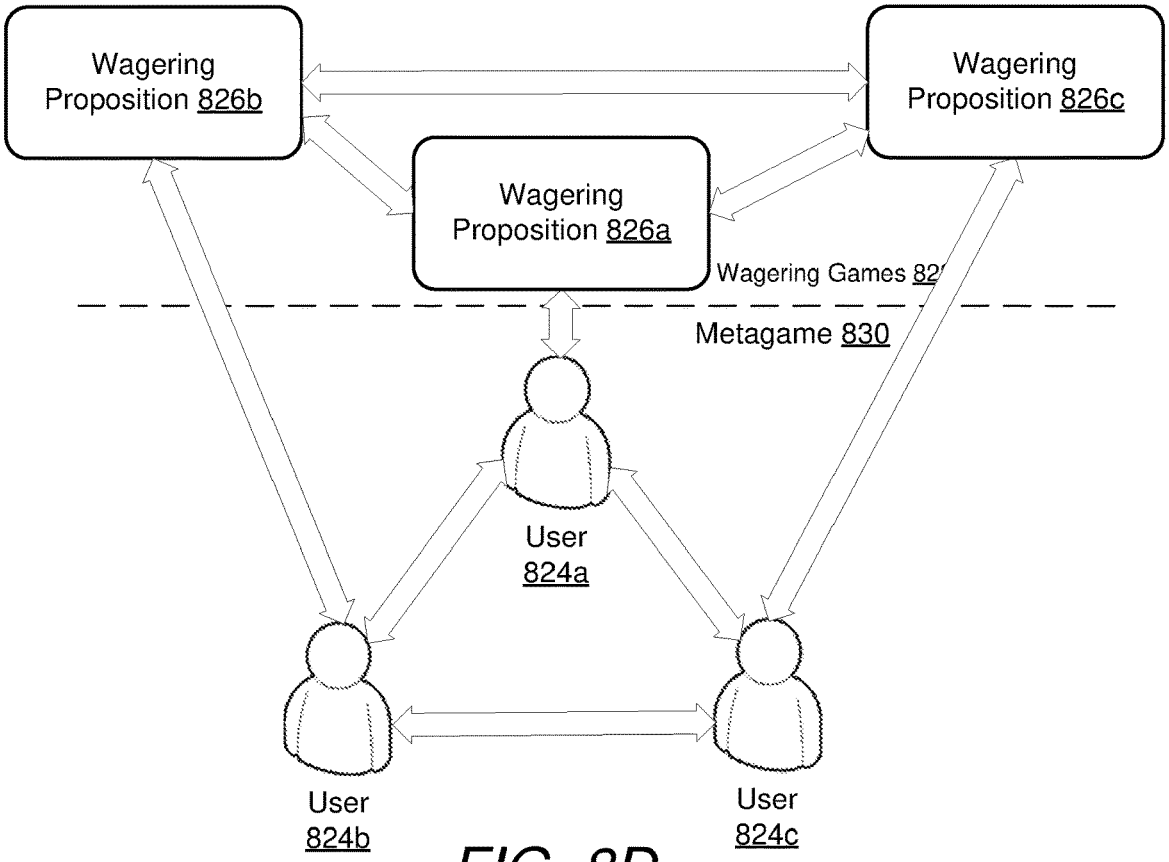

Referring now to FIG. 8D, a social network includes a group of users, such as users 824*a*, 824*b*, and 824*c*, who interact with each other. Their interactions are in accordance with a set of rules that constitute a social network metagame 830 of a social network wagering system. Two or more members of the group also interact with two or more respective wagering propositions, such as wagering propositions 826*a*, 826*b*, and 826*c* of two or more wagering games 828 being provided by the social network wagering system. The two or more wager propositions interact with each other in accordance with a set of wagering game interaction rules. In some embodiments, events that occur during the social network metagame affect the wagering proposition of the wagering games. In some embodiments, events that occur during the wagering games affect the social network metagame.

Figure 9:
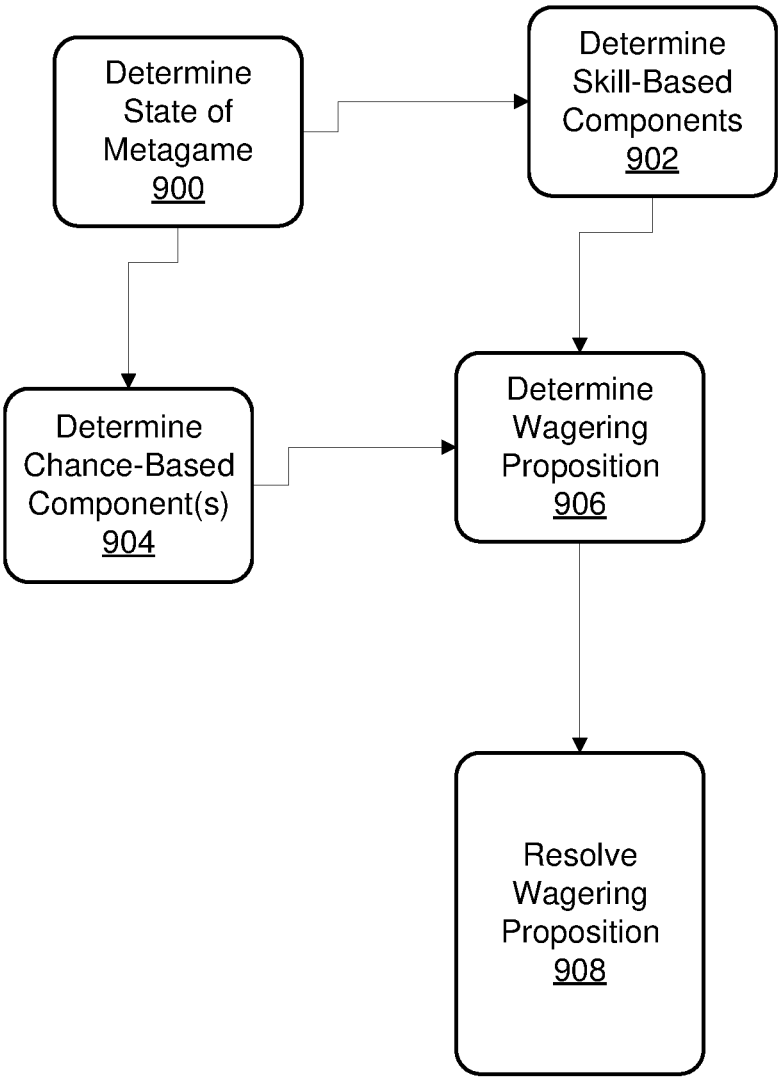
FIG. 9 is a block diagram illustrating a process of a wagering proposition of a social network wagering system in accordance with various embodiments of the invention.

FIG. 9 is a block diagram illustrating a process of a wagering proposition of a wagering game of a social network wagering system in accordance with various embodiments of the invention. A social network wagering system determines 900 a state of a social network metagame as described herein. The social network wagering system uses the state of the social network metagame to determine 902 one or more skill-based components of a wagering proposition. In addition, the social network wagering system uses the state of the metagame to determine 904 one or more chance-based components of the wagering proposition. The social network wagering system uses the chance-based components and the skill-based components to determine 906 the wagering proposition. The social network wagering system presents the wagering proposition to a user and the user interacts with the wagering proposition. The social network wagering system receives the user interactions and uses the user interactions to resolve 908 the wagering proposition.

Figure 10:
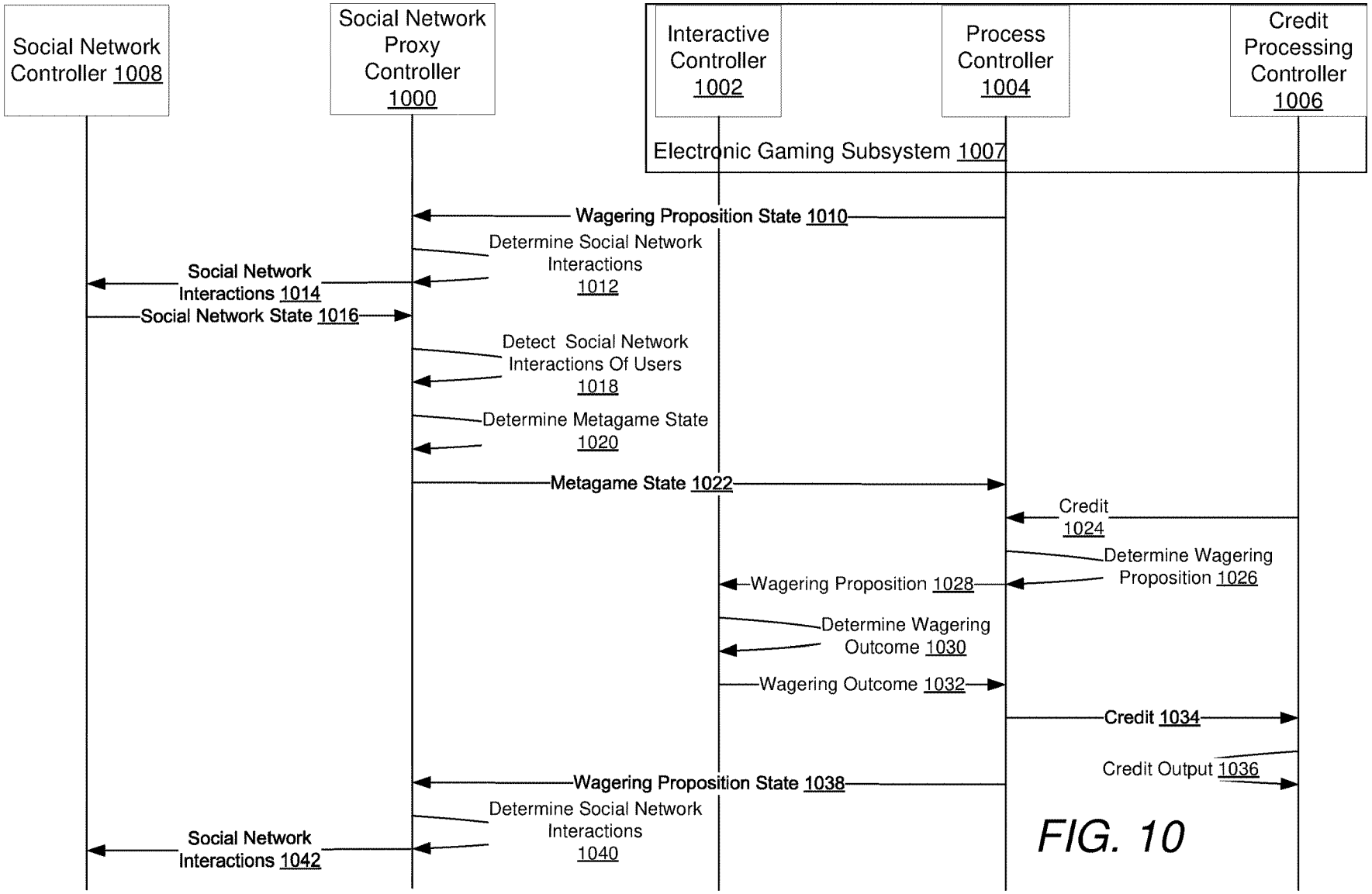
FIG. 10 is a sequence diagram of interactions between components of a social network wagering system during a wagering process in accordance with various embodiments of the invention.

FIG. 10 is a sequence diagram of interactions between components of a social network wagering system during a wagering process in accordance with various embodiments of the invention. The components of the social network wagering system include a social network proxy controller 1000, an interactive controller 1002, a process controller 1004, and a credit processing controller 1006. The social network wagering system may also be operatively connected to a social network controller 1008. In many embodiments, the interactive controller 1002, process controller 1004, and credit processing controller 1006 are included in an electronic gaming subsystem 1007 of a social network wagering system as described herein.

In operation, the process controller 1004 communicates wagering proposition state data 1010 to the social network proxy controller. The wagering proposition state data includes current game state data for a wagering proposition that may be presented to a user. The social network proxy controller receives the wagering proposition state data and determines 1012 one or more social network interactions based on the wagering proposition state data. Social network interaction data 1014 of the social network interactions are communicated by the social network proxy controller 1000 to the social network controller 1008. In addition, the social network proxy controller 1000 receives social network state data 1016 from the social network controller 1008. The social network proxy controller 1000 receives the social network state data 1016 and detects 1018 social network interactions of users from the social network state data. The social network proxy controller uses the social network interactions of users and the social network proxy controller to determine 1020 a social network metagame state for a metagame being played by the users and components of the social network wagering system in accordance with a set of social network metagame game rules. The social network proxy controller 1000 communicates data of the social network metagame state 1022 to the process controller 1004.

In some embodiments a user inputs one or more credits for the wager process into the social network wagering system with the process controller 1004 receiving incoming credit data 1024 from the credit processing controller 1006. The process controller 1004 uses the incoming credit data 1024 to transfer credits onto one or more user credit meters associated with one or more users of the social network wagering system, thus transferring credits into the social network wagering system and on to the one or more user credit meters.

The process controller 1004 uses the social network metagame state to determine 1026 a wagering proposition. In some embodiments, the social network metagame state is used to determine a set of chance-based components for the wagering proposition. In various embodiments, the social network metagame state is used to determine skill-based components of the wagering proposition. In some embodiments, the social network metagame state is used to determine chance-based components and skill-based components of the wagering proposition. Process controller communicates wagering proposition data 1028 of the wagering proposition to the interactive controller. The interactive controller presents the wagering proposition to one or more users and receives user interactions with the wagering proposition to determine a wagering proposition outcome 1030. Data of the wagering proposition outcome 1032 is communicated to the process controller 1004. The process controller uses the wagering proposition outcome data to update one or more credit meters associated with one or more users.

The process controller 1004 determines a wagering proposition state based at least in part on the wagering proposition outcome and communicates data of the wagering proposition state 1038 to the social network proxy controller 1000. The social network proxy controller 1000 receives the wagering proposition state data and determines 1040 one or more social network interactions based in part on the wagering proposition state data. The social network proxy controller 1000 communicates data of the one or more social network interactions 1042 to the social network controller 1008.

In many embodiments, upon determining that the wagering process is completed, such as by receiving a cashout communication from one or more users of the social network wagering system, the process controller 1004 transfers credits off of the one or more user credit meters, generates outgoing credit data 1034 on the basis of the credits transferred off of the one or more user credit meters, and communicates the outgoing credit data 1034 to the credit processing controller 1006. The credit processing controller 1006 receives the outgoing credit data 1034 and generates 1036*s* a credit output as described herein, thus transferring credits off of the one or more user credit meters and out of the social network wagering system.

In some embodiments, at a beginning of the wagering process, the process includes an application credit input to the social network wagering system with the process controller communicating with the credit processing controller to receive incoming application credit data. The process controller uses the incoming application credit data to transfer application credits onto one or more application credit meters associated with one or more users of the social network wagering system, thus transferring application credits into the social network wagering system and on to the one or more application credit meters. The process controller uses the skill outcome data to determine an amount of application credit to award to a user based on the user's skillful interactions with an interactive application executed by the interactive controller. Upon determining that the wagering process is completed, such as by receiving a cashout communication from one or more users of the social network wagering system, the process controller transfers application credits off of the one or more application credit meters, generates outgoing application credit data on the basis of the application credits transferred off of the one or more application credit meters, and communicates the outgoing application credit data to the credit processing controller 903. The credit processing controller receives the outgoing application credit data and generates an application credit output as described herein, thus transferring application credits off of the one or more application credit meters and out of the social network wagering system.

In various embodiments, the skill-based components of the wagering proposition are a set of one or more skill objectives in an interactive application wherein the skill objectives are to be achieved by one or more users. A wager of an amount of credits is received from a user and the user is awarded a fixed award of an amount of credits for achieving one or more skill objectives of a wagering proposition where a probability that the user will be able to achieve the one or more skill objectives is inversely proportional to the fixed award of an amount of credits such that the more difficult the one or more skill objectives are, the higher the fixed award of an amount of credits awarded to the user. The one or more skill objectives are randomly selected using a random outcome of a random number generator. The random outcome is mapped to various parameters and rule sets of skill objectives having varying difficulties to create a skill-based component of the wagering proposition. Accordingly, the random outcome determines a difficulty of the one or more skill objectives but not the fixed award of an amount of credits awarded to the user for achieving the one or more skill objectives and it is up to the skill of the user to achieve the one or more skill objectives of the wagering proposition and be awarded the fixed award of an amount of credits associated with the one or more skill objectives.

In an example embodiment, an interactive application provides a skill-based puzzle piece drop game to a user, and the user is awarded with a fixed award of an amount of credits for achieving skill objectives of positioning dropped puzzle pieces composed of squares to complete rows. The squares of the puzzle pieces have a range of colors and completing a row in a single color results in an award of the fixed award of an amount of credits. Whether or not a next puzzle piece will allow the user to complete a row in a particular color is determined by a random outcome used to generate a chance-based component of a wagering proposition. In some such embodiments, the user lines up groups of blocks in various shapes to create a completely filled row. Each time the user creates a single row of blocks that are the same color, the user is awarded a fixed award of an amount of credits; each time the user creates two rows of blocks that are the same color, the user is awarded a higher fixed award of an amount of credits; etc. At the start of each level, the random outcome is used to randomly determine the color, order, and shape of the blocks given to the user to create rows. Sometimes the user is provided with the shapes and colors in an order that facilitates the creation of rows. Sometimes the user is provided with shapes and colors that they can do nothing with. Sometimes a skillful user will only be able create a few individual rows of one color and they will be awarded a fixed award of an amount of credits less than an amount of credits wagered by the user (thus resulting in a partial win for the user); sometimes a skillful user will be able to create multiple rows of one color and the user will be awarded an amount of credits equal to an amount of credits wagered by the user (thus allowing the user to break even); and sometimes a skillful user will be able to create a significant number of rows of one color and they will be awarded an amount of credits greater than an amount of credits wagered by the user (thus resulting in a win for the user). An unskilled user may be awarded no credits, resulting in a complete loss for the user.

In another example embodiment, a skill-based component is implemented in a first person shooter style skill-based game provided by an interactive application. The skill-based game has skill objectives in the form of opponents that are engaged by the user. Some opponents stay engaged until they are defeated. If a user achieves a skill objective by defeating an opponent, the user is awarded a fixed award of an amount of credits. Other opponents run away before being defeated, resulting in no award of credits. Whether or not the opponent stays engaged or runs away is determined by chance-based component generated from a random outcome. In such an embodiment, the user is always awarded for defeating an opponent and the fixed award of an amount of credits awarded for defeating the opponent is constant. In some such embodiments, each time a low level opponent is defeated, the user is awarded a low fixed award of an amount of credits less than an amount of credits wagered by the user (thus resulting in a partial win for the user); each time an intermediate level opponent is defeated, the user is awarded an intermediate fixed award of an amount of credits equal to an amount of credits wagered by the user (thus resulting in the user breaking even); and each time a highest level opponent is defeated, the user is awarded a highest fixed award of an amount of credits greater than an amount of credits wagered by the user (thus resulting in a win for the user).

At the start of each level, the random outcome randomly determines the type of opponents that appear. There are opponents that cannot be defeated; there are opponents that will automatically defeat the user if the user shoots them, but the user doesn't know which opponent they are dealing with; on some levels, no defeatable opponents appear; etc. Sometimes a skillful user will only be able to defeat a few opponents before an opponent defeats the user and the user will be awarded a minimal amount of credits; sometimes a skillful user will be able to defeat a few opponents and the user will be awarded an amount of credits such the user breaks even or makes a little bit more than an amount of credits wagered; and sometimes a skillful user will be able to defeat a high level opponent and dozens of lower level opponents and the user will be awarded a significant amount of credits. An unskilled user may get the chance to defeat the highest level opponent, but because the user isn't skillful enough to defeat the highest level opponent, the user is awarded no credits.

In an example embodiment, a pinball-style video game is provided as a wagering proposition by an interactive application executed by an interactive controller. The base skill objective of a skill-based component is to strike targets, sometimes referred to as toys, in a playing table of the pinball game using a pinball directed by the user using paddles or flippers. The user wagers credits against the user's skillful play of the skill-based game. The user is awarded points for each target struck as a skill metric. When the skill metric reaches one or more specified levels, the user is awarded with corresponding one or more fixed awards in amounts of credits. In various embodiments, the one or more chance-based components are in the form of one or more bumpers introduced into the playing table of the video pinball game such that the user must avoid striking the one or more bumpers in order to continue playing the pinball game. The placement and or location of the bumpers is determined by a random outcome. In some such embodiments, once one of the one or more bumpers are struck with a pinball, the user loses the pinball, that is the probability that a user can achieve the skill objective of overcoming the bumpers is 0. Accordingly, the user is prevented from achieving a base skill objective of the skill-based component of accumulating enough points in a skill metric to be awarded the fixed award of an amount of credits.

In other embodiments, a chance-based component is introduced as a ball save feature. As the user plays the skill-based component of the video pinball game, the user will eventually miss striking the pinball with the flippers or paddles, thus losing the pinball as an intermediate loss. The pinball is returned to the user on the basis of a random outcome, thus enabling the user to complete the base skill objective of the skill-based component of accumulating enough points in a skill metric to be awarded the fixed award of an amount of credits.

In another embodiment, a racing game is provided as a wagering proposition of an interactive application of an interactive controller. A user wagers on the user's skill in overtaking non-user characters during a simulated race. During the simulated race, a user is presented with one or more skill-objectives of overtaking an opponent non-user character in the form of another racer. The characteristics of the non-user character are determined as a chance-based component using a random outcome as described herein. If the user is able to overtake and pass the opponent non-user character, the user is awarded a fixed award of an amount of credits. In another such embodiment, the user wagers on their skill in navigating around a course by a set amount of time. As the user navigates around the course to complete the course, chance-based components in the form of obstacles are randomly introduced into the racing game in the form of obstacles. Some obstacles cause the user to crash regardless of the skill of the user, that is the obstacles are chance-based components giving the user a probability of 0 that the user can skillfully achieve the skill objective of overcoming the chance-based component. In various embodiments, a chance-based component is randomly introduced into the racing game that enables the user to complete a skill-objective of a skill-based component, such as, but not limited to, adding fuel for a vehicle being raced by the user. Without the chance-based component, the user is unable to complete a skill objective such that the user is awarded a fixed award of an amount of credits.

Figure 11:
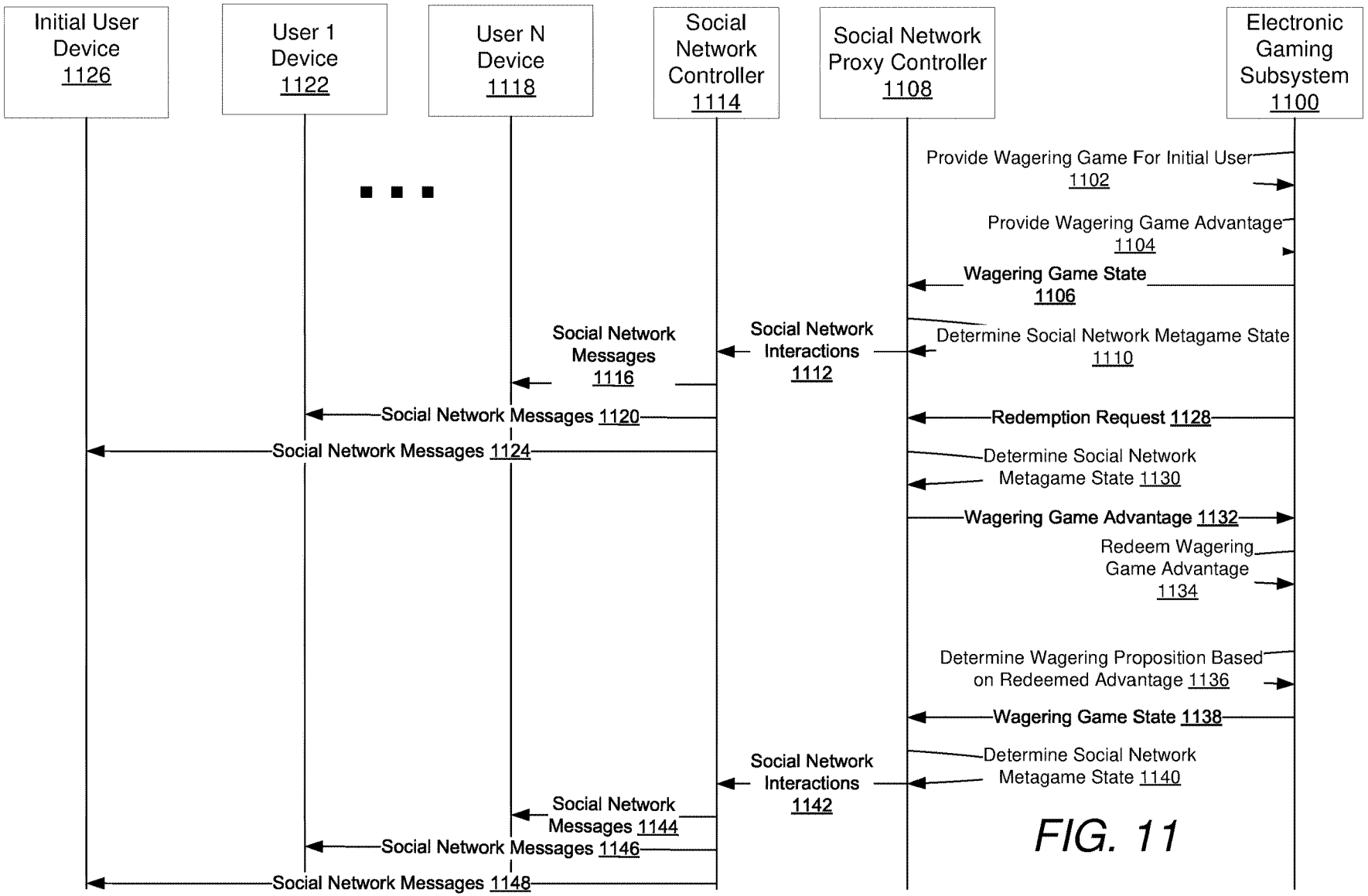
FIG. 11 is a sequence diagram of a social network metagame for awarding a wagering proposition advantage of a wagering process social network wagering system in accordance with various embodiments of the invention.

FIG. 11 is a sequence diagram of a social network metagame and wagering process implemented by social network wagering systems in accordance with various embodiments of the invention. During the social network metagame and wagering process, an electronic gaming subsystem 1100 provides 1102 a wagering game including determining a wagering proposition for an initial user. The wagering proposition may include skill-based components and chance-based components as described herein. The wagering proposition may be for any type of wagering game that may be provided by the electronic gaming subsystem, such as, but not limited to, various embodiments of wagering games as described herein. As the initial user plays the wagering game, the electronic gaming subsystem provides 1104 one or more wagering game advantages to the initial user.

In various embodiments, a wagering game advantage may be an advantage provided to a user during the user's attempt to achieve a skill objective of a skill-based component of a wagering game. An example embodiment of such an advantage is a power-up in a skill-based game.

In some embodiments, a wagering game advantage may be an advantage provided to a user corresponding to a chance-based component of a wagering game. An example embodiment of such an advantage is a better paytable that provides a better return to player (RTP) to the user.

During gameplay of the wagering game, the initial user determines that they want to provide the wagering game advantage to another user provided that the other user participates in a social network metagame. In an example embodiment, the social network metagame is an Easter egg-style game wherein one or more users are challenged to find the specific electronic gaming subsystem that the initial user is using from among a plurality of electronic gaming subsystems, such as finding a specific electronic gaming machine in a casino.

In response to a user input, the electronic gaming subsystem communicates 1106 data of the wagering game state to a social network proxy controller or server 1108. In some embodiments, the wagering game state includes, but is not limited to, an identifier of the electronic gaming subsystem, attributes of a wagering game advantage, and social network identifying data for the initial user, and social network identifying data for one or more users that is provided by the initial user.

The social network proxy controller or server 1108 receives the wagering game state data and determines 1110 a social network metagame state. In an example embodiment, the social network metagame is for an Easter egg-style hunt for the electronic gaming subsystem wherein whoever finds the electronic gaming subsystem will be able to utilize the wagering game advantage that was awarded to the initial user.

The social network metagame is initialized using the wagering game state data. In an example embodiment, a social network metagame state includes data about the location of the electronic gaming subsystem, attributes of the wagering game advantage, and an indication that the social network metagame has started.

The social network proxy server uses data of the social network metagame state to determine one or more social network interactions 1112 that will be used to communicate with a social network controller or server 1114. In an example embodiment, the social network metagame is an Easter egg-style hunt for the electronic gaming subsystem that has one or more wagering game advantages that may be redeemed by the first user who finds the electronic gaming subsystem. The social network interactions include hints that will be given to users on how to find the electronic gaming subsystem, a description or hint regarding the attributes of the one or more wagering game advantages, and one or more social network identifiers of one or more users so that the one or more users can be invited to join the social network metagame by hunting for the electronic gaming subsystem.

The social network proxy controller or server 1108 communicates data of the social network interactions to the social network controller or server 1114. In response, the social network controller or server 1114 communicates one or more social network messages, such as social network messages 1116, 1120, and 1124, to one or more user devices, as exemplified by initial user device 1126, and user devices user 1 device 1122 to user N device 1118, corresponding to one or more users other than the initial user. In an example embodiment, the social network metagame is an Easter egg-style hunt and the social network messages communicated to the one or more user devices of the one or more users are invitations to the one or more users to hunt for the electronic gaming subsystem having one or more wagering game advantages that are available for redemption by the first user who can find the electronic gaming subsystem.

When a user finds the electronic gaming subsystem, the user requests redemption of the wagering game advantage provided by the initial user. The electronic gaming subsystem 1100 communicates data of a redemption request 1128 for the wagering game advantage to the social network proxy controller or server 1108. In some embodiments, the user identifies themselves to the electronic gaming subsystem 1100 using the user's respective social network identifier data and the user's respective social network identifier data is included in the redemption request data 1128.

The social network proxy controller or server 1108 receives the redemption request 1128 and uses the redemption request data 1128 to update 1130 the social network metagame state to indicate that the wagering game advantage has been redeemed. The social network proxy controller communicates data of the wagering game advantage 1132 to the electronic gaming subsystem 1100. The electronic gaming subsystem 1100 receives the wagering game advantage data 1132 and redeems 1134 the wagering game advantage for the user by using the wagering game advantage when determining 1136 a wagering proposition for the user.

The electronic gaming subsystem 1100 communicates data of the wagering game state 1138 to the social network proxy controller or server 1108. In some embodiments, the wagering game state data 1138 includes data about the redemption of the wagering game advantage by the electronic gaming subsystem.

The social network proxy controller or server 1108 receives the wagering game state data 1138 and determines 1140 the state of the social network metagame using the wagering game state data 1138. In some embodiments, the social network metagame is an Easter egg-style hunt and the wagering game state data includes wagering game advantage redemption data indicating that a wagering game advantage have been redeemed, therefore; the Easter egg-style hunt has come to an end.

The social network proxy controller or controller or server 1108 uses data of the social network metagame state to determine data of social network interactions 1142 that are used to communicate the social network metagame state to the social network controller. The social network proxy controller or server communicates data of the social network interactions 1142 to the social network controller or server 1114. The social network controller or server 1114 receives the social network interaction data 1142 and uses the social network interaction data 1142 to generate one or more social network messages, such as social network messages 1144, 1146, and 1148, to that are communicated to one or more user devices of one or more users, such as initial user device 1126, user 1 device 1122, and user N device 1118. In an example embodiment, the social network messages indicate that a social network metagame that is an Easter egg-style hunt has ended because a user has been able to find a specified electronic gaming subsystem and has been successful in redeeming a wagering game advantage left by an initial user.

In some embodiments, the initial user purchases the wagering game advantage as an in-application purchase.

In various embodiments, the wagering game advantage is provided to the initial user by another user as an in-application purchase.

In many embodiments, the wagering game advantage is provided to the initial user based on an amount of time that the initial user plays the wagering game.

In some embodiments, the wagering game advantage is provided to the user on the basis of an amount of a wager of credits by the initial user.

Figure 12:
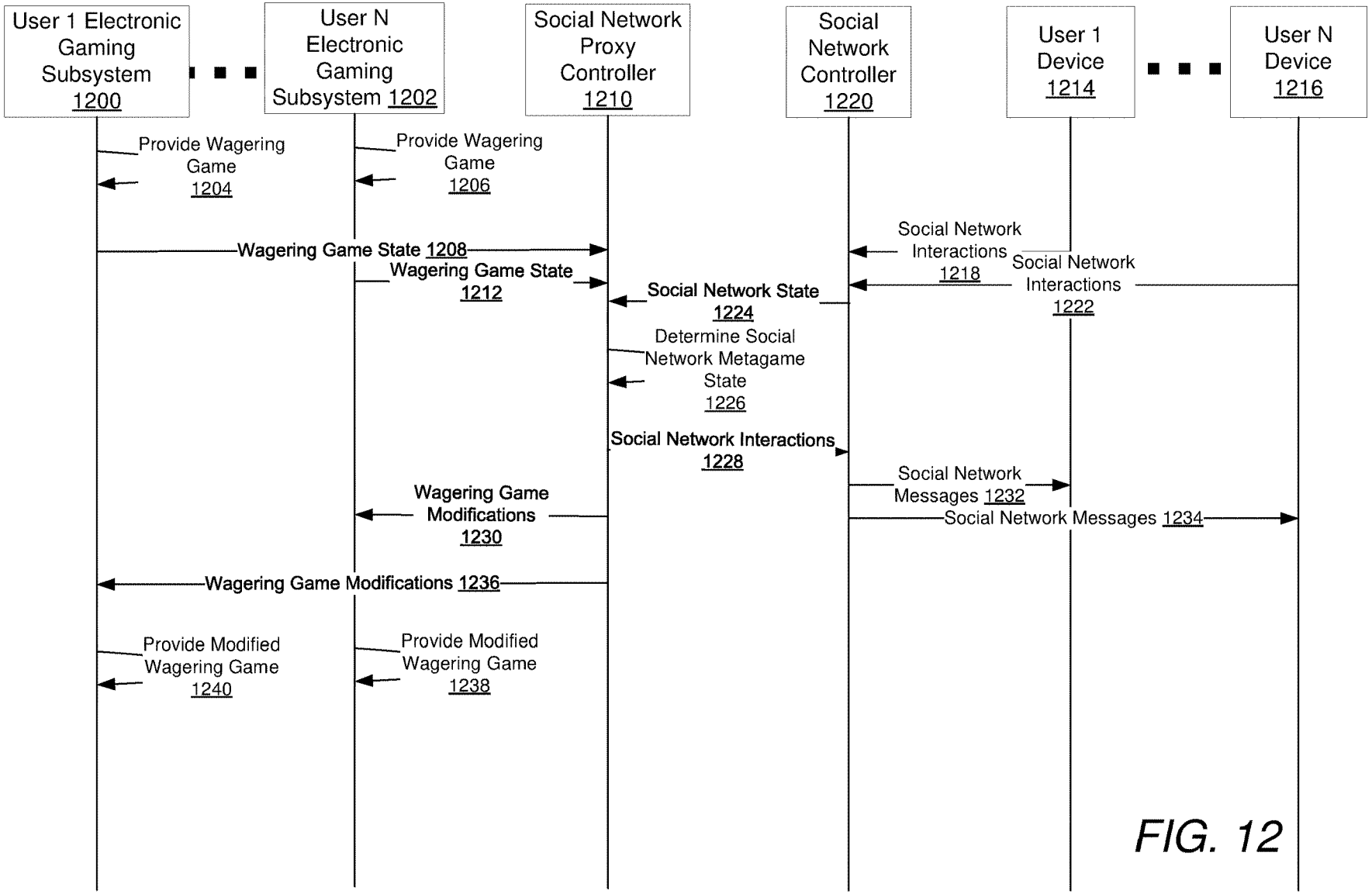
FIG. 12 is another sequence diagram of a social network metagame for awarding a wagering proposition advantage of a wagering process social network wagering system in accordance with various embodiments of the invention.

FIG. 12 is a sequence diagram of another social network metagame and wagering process implemented by social network wagering systems in accordance with various embodiments of the invention. Two or more users who are part of a social network group are provided, 1204 and 1206, two or more respective wagering games by two or more respective electronic gaming subsystems such as electronic gaming subsystems 1200 and electronic gaming subsystems 1202. The two or more electronic gaming subsystems communicate wagering game state data, such as wagering state data 1208 and 1212, about the state of the two or more respective wagering games to a social network proxy controller or server 1210. Two or more respective user devices, such as user devices 1214 and 1216, of the two or more users communicate data of social network interactions, such as social network interactions 1218 and 1222, to the social network controller or server 1220. The social network proxy controller or server 1210 monitors the social network controller or server 1220, to detect social network state data 1224 representing a state of the social network interactions of the two or more users.

The social network proxy controller or server uses the social network state data to determine 1226 a social network metagame state. The social network proxy controller or server 1210 uses the social network metagame state to determine a set of social network interactions and communicates data of the social network interactions 1228 to the social network controller or server 1220. In response to the social network interactions, the social network controller or server 1220 communicates data of social network messages, such as social network message data 1232 and 1234, to the two or more user devices 1214 and 1216.

The social network proxy controller 1210 uses the social network metagame state to determine one or more wagering game modifications and communicates data of the one or more wagering game modifications, such as wagering game modification data 1230 and 1236, to the two or more electronic gaming subsystems, such as electronic gaming subsystems 1200 and 1202. The two or more electronic gaming subsystems receive the wagering game modification data and user the wagering game modification data to provide, 1240 and 1238, two or more modified wagering games to the respective users of the two or more electronic gaming subsystems.

In an example embodiment, a social network metagame includes monitoring the social networking activities of a social group of two or more users and providing wagering proposition advantages to the entire social group based on the their social network activities. As the social group wagers, members of the social group post information about their wagering to the social network controller as social network interaction. The social network proxy controller collects the postings of the members of the social group as part of the social network state. The social network proxy controller determines the social network metagame state based on the postings by the social group. The social network proxy controller determines to provide wagering proposition advantages to the members of the social group based on the social network metagame state; accordingly, the wagering game modification data includes instructions to the two or more electronic gaming subsystems to offer one or more the social network metagame state to the two or more respective users of the two or more electronic gaming subsystems. Example embodiments of wagering proposition advantages include, but are not limited to: providing a skill enhancement within a skill-based portion of the wagering proposition such as a power up, special item, more favorable starting game world, etc.; and providing a chance-based enhancement for a chance-based portion of a wagering proposition such as a free wager, a more favorable paytable, additional wagering credits that can't be withdrawn, etc. Example embodiments of a social network metagame state that would cause the social network proxy controller to provide one or more wagering proposition advantages include, but are not limited to: reaching a specified number of members in the social group; reaching a specified number of postings by members of the social network; reaching a specified rate of postings by members of the social network; detecting that the one or more of postings contain a phrase, brand name, location, etc. associated with an operator of one or more of the electronic gaming subsystems; detecting that one or more members within the social group has made an in-application-purchase.

In some embodiments, the wagering proposition advantages remain so long as one or more members of the social network continue to make postings.

In various embodiments, one or more members of the group gift a wagering proposition advantage to one or more other members of the group as part of the member's social network interactions.

In some embodiments, one or more members of the social group are not associated with a respective electronic gaming subsystem. In several such embodiments, the one or more members of the social group that are not associated with a respective electronic gaming subsystem are outside of a regulated real money gaming environment and do not participate in any wagering propositions.

In various embodiments, the members of the social group participate in playing a multiplayer game on one or more electronic gaming subsystems. In some such embodiments, the multiplayer game is a competitive game played between two or more users. In other such embodiments, the multiplayer game is a cooperative game played by two or more users. In several such embodiments, the multiplayer game is played on two or more electronic gaming subsystems, with at least one electronic gaming subsystem being located in a regulated real money gaming environment and at least one electronic gaming subsystem being located outside of the regulated real money gaming environment.

In some embodiments, a cooperative multiplayer game includes cooperative skill objectives that are achieved by the members of the group. When the cooperative skill objective is achieved by the social group, wagering proposition advantages are unlocked and provided to one or more members of the social group. Example embodiments of cooperative games include, but are not limited a simulation game to build a city, a simulation game to grow crops, a scavenger hunt within a casino or other real money gaming environment, etc.

In some embodiments, the social network metagame includes one or more members of the social group purchase one or more wagering proposition advantages that are then gifted to one or more other members of the social networking group. When the other one or more members of the social network group utilize the wagering proposition advantage, one or more additional wagering proposition advantages are provided to one or more members of the social group based on the wagering proposition outcome of the other members of the social networking group. In an example embodiment, if the other members of the social networking group are able to improve their wagering proposition outcomes by successfully utilizing the gifted wagering proposition advantages, then the additional wagering proposition advantages are provided; however, if the other members of the social networking group are unable to improve their wagering proposition outcomes because the other members of the social networking group unsuccessfully utilize the gifted wagering proposition advantages, then the additional wagering proposition advantages are not provided.

In various embodiments, the social network metagame includes requesting by one or more members of the social group that one or more other members of the social group provide a gift of one or more wagering proposition advantages.

In some embodiments, the social network metagame is a competitive game wherein the members of the social group compete against each other. When a member of the social group makes wagers in accordance with a wagering proposition, the member is provided with a social network metagame advantage to use within the social network metagame. In an example embodiment, the social network metagame is based on the TV show Survivor™. During the social network metagame two or more members of the social group may vote to remove from play one or more other members of the social group. In some embodiments voted out members of the social group can stay in the metagame to be in a "peanut gallery" of social group members who make comments. In such an embodiment, an example social network metagame advantage is to be immune from being voted out of the social network metagame.

In various embodiments, a social network metagame includes contributing funds to a charity by members of a social group. In an example embodiment, the greater an amount the social group donates to charity, a greater a number of wagering proposition advantages are provided to one or more members of the social group.

In some embodiments, the social group is an ad hoc group created by sending invitations onto individual user's devices through near field communication NFC) protocols or wider ranged Bluetooth protocols or the like.

In various embodiments, a social network proxy controller or server is associated with one or more respective electronic gaming subsystems and engages in a social network as "chatbot" or other type of automated user. In some such embodiments, the automated user employs artificial intelligence (AI) algorithms to generate content for the social network. In many such embodiments, the automated user identifies members if social network through NFC location protocols. In various embodiments, the output of the automated user is associated with a game state. In some such embodiments, the automated user also generates audio-visual content for use of social networks that allow videos such as Snapchat and Instagram.

In some embodiments, an ad hoc social group of a social network of two or more users is determined from a group leaderboard for a gaming tournament.

In various embodiments, a user can purchase a "hot event" or special event that is communicated to one or more user via a social network.

In some embodiments, a user "friends" an automated user associated with an electronic gaming subsystem. The automated user accesses social network postings of the user to generate coupons or incentives and send coupons and incentives to others that are within a social network of the user. Recipients of the incentives and coupons use them to gamble on the associated electronic gaming subsystem.

In many embodiments, users within a social network pool their wagers using the social network. In some such embodiments, the users engage in sidebets on the wagering of other users wherein a user's sidebet is added to the credits that another user is wagering.

In some embodiments, a group wager is made where a skill proposition outcome for the group wager is taken as the best skill outcome for two or more users of a social network. In various such embodiments, a best gambling outcome for a wager is taken as the best wager outcome for two or more users of a social network. In many such embodiments, a previous user's outcome is used as a "ghost" outcome that is shared by all members of a social network of users.

In some embodiments, one or more of the electronic gaming subsystems include "toppers" that are additional visual display devices. The additional visual display devices are used to communicate social networking data, such as social network communications for display to one or more users or QR codes used to communicate data of other users or electronic gaming subsystems directly to user devices.

In various embodiments, a social network metagame includes communicating data of skill progressive tournaments with as yet uncollected wins. In some embodiments, a social network metagame includes social group vs. social group competition where a pooled award amount of credit is created and a skill outcome determines which of the groups gets the pool.

In many embodiments, a social network metagame includes having at least one member of a social network continuously wagering so that the entire social network may continue receiving tiered rewards. On some such embodiments, a "thermometer" type visual display increases so long as a member of the social network is wagering, but degrades if no member of the social network is wagering.

In various embodiments, a social network metagame includes users playing a traditional game, such as a Twister style game or Monopoly. In some embodiments, the traditional game is an online video game such as Freedom or the like.

While the above description may include many specific embodiments of the invention, these should not be construed as limitations on the scope of the invention, but rather as examples of embodiments thereof. It is therefore to be understood that the invention can be practiced otherwise than specifically described, without departing from the scope and spirit of the invention. Thus, embodiments of the invention described herein should be considered in all respects as illustrative and not restrictive.

What is claimed:

1. A system for social network wagering, comprising:

an electronic gaming subsystem for wagering, comprising:

an enclosure constructed to mount:

a user input device;

a user output device;

a credit input device; and a credit output device; and a random number generator, wherein the electronic gaming subsystem is constructed to:

communicate with the credit input device to receive a credit input;

credit a credit meter with credits based on the incoming credit data;

receive a first social network metagame state from a social network proxy controller;

determine a wagering proposition based on the social network metagame state;

determine a wagering proposition outcome for the wagering proposition;

update the credit meter based on the wagering proposition outcome;

communicate wagering game state data to the social network proxy controller; and communicate with the credit output device to generate a credit output based on credits transferred off of the credit; and the social network proxy controller connected to the electronic gaming subsystem, wherein the social network proxy controller is constructed to:

communicate the first social network metagame state from the social network proxy controller to the electronic gaming subsystem;

receive the wagering game state data from the electronic gaming subsystem;

generate social network interactions based on the wagering game state data; and determine a second social network game state using the social network interactions and the wagering game state data.

2. The system for social network wagering of claim 1, wherein the electronic gaming subsystem and the social network proxy controller are constructed from the same device.

3. The system for social network wagering of claim 1, wherein the social network proxy controller is further constructed to communicate with a social network controller.

* * * * *